US007377627B2

(12) United States Patent
Muranaka et al.

(10) Patent No.: US 7,377,627 B2
(45) Date of Patent: May 27, 2008

(54) INK CARTRIDGE, HOUSING THEREFOR, INK BAG, INK-JET RECORDING APPARATUS, INK CONTAINER, AND IMAGE-FORMING APPARATUS

(75) Inventors: Masakazu Muranaka, Tokyo (JP); Tetsuya Hiruma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 221 days.

(21) Appl. No.: 10/537,368

(22) PCT Filed: Dec. 2, 2003

(86) PCT No.: PCT/JP03/15440

§ 371 (c)(1),
(2), (4) Date: Oct. 21, 2005

(87) PCT Pub. No.: WO2004/052652

PCT Pub. Date: Jun. 24, 2004

(65) Prior Publication Data

US 2006/0139420 A1 Jun. 29, 2006

(30) Foreign Application Priority Data

Dec. 6, 2002 (JP) ..... 2002-354958
Nov. 18, 2003 (JP) ..... 2003-387507

(51) Int. Cl.
*B21J 2/175* (2006.01)

(52) U.S. Cl. ..... 347/86

(58) Field of Classification Search ..... 347/49, 347/85, 86; 222/105, 568
See application file for complete search history.

(56) References Cited

U.S. PATENT DOCUMENTS 4,819,012 A * 4/1989 Kiyohara et al. ..... 347/30
5,666,146 A 9/1997 Mochizuki et al.
5,788,388 A 8/1998 Cowger et al.
5,839,368 A * 11/1998 Ohinata ..... 101/364
5,860,363 A 1/1999 Childers et al.
5,956,057 A * 9/1999 Childers et al. ..... 347/49
6,017,118 A 1/2000 Gasvoda et al.
6,033,610 A 3/2000 Swanson et al.
6,220,702 B1 * 4/2001 Nakamura et al. ..... 347/86
6,264,314 B1 7/2001 Mochizuki et al.

(Continued)

FOREIGN PATENT DOCUMENTS

EP 0816098 A2 1/1998

(Continued)

OTHER PUBLICATIONS

European Search Report in connection with European application EP 03 81 2699.

*Primary Examiner*—Anh T. N. Vo
(74) *Attorney, Agent, or Firm*—Cooper & Dunham LLP

(57) ABSTRACT

An ink cartridge includes an ink containing part and first through third housings. The ink containing part includes a holding member with an ink supply opening part and a sealed ink filling opening part. The first housing includes a holding part holding the holding member of the ink containing part. The second housing has an outline analogous to that of the first housing. The third housing is fitted to the side of the assembly of the first and second housings from which side ink is supplied. The first, second, and third housings are assemblable and disassemblable.

43 Claims, 25 Drawing Sheets

U.S. PATENT DOCUMENTS

| | | | | |
|---|---|---|---|---|
| 6,364,472 | B1 * | 4/2002 | Hmelar et al. | 347/85 |
| 6,416,166 | B1 | 7/2002 | Robinson et al. | |
| 6,609,789 | B1 * | 8/2003 | Hunt | 347/86 |

FOREIGN PATENT DOCUMENTS

| | | |
|---|---|---|
| JP | 59-227458 | 12/1984 |
| JP | 60-32671 | 2/1985 |
| JP | 63-15752 | 1/1988 |
| JP | 10-202900 | 8/1998 |
| JP | 10-202901 | 8/1998 |
| JP | 3024260 | 1/2000 |
| JP | 2001-18415 | 1/2001 |
| JP | 2001-24763 | 1/2001 |

* cited by examiner

INK CARTRIDGE, HOUSING THEREFOR, INK BAG, INK-JET RECORDING APPARATUS, INK CONTAINER, AND IMAGE-FORMING APPARATUS

TECHNICAL FIELD

The present invention relates to an ink cartridge, a housing therefor, an ink bag, an ink-jet recording apparatus, an ink container, and an image-forming apparatus.

BACKGROUND ART

An ink-jet printer is a well-known one of image-forming apparatuses (or image-recording apparatuses) such as printers, facsimile machines, and copiers. The ink-jet printer performs recording on a recording medium such as paper (recording paper) by ejecting ink thereonto from a recording head. The recording medium is not limited to paper. The recording medium refers to a medium on which an image is formable. The recording medium may also be an OHP (overhead projector) sheet, for instance. The ink-jet printer can record a high-definition image at high speed with reduced noise at low running cost. Further, the ink-jet printer enjoys another advantage of easiness in recording a color image using multiple color inks.

An ink cartridge having a housing formed of a rigid rectangular shell and an ink reservoir filled with ink in the housing as disclosed in U.S. Pat. No. 5,788,388 (Prior Art 1) and an ink cartridge having a flexible bag-like ink reservoir with an ink outlet and a chassis (housing) with an opening through which the ink reservoir is insertable into and extractable from the chassis as disclosed in U.S. Pat. No. 5,860,363 (Prior Art 2) are well known as ink cartridges that are ink containing parts employed in the conventional ink-jet recording apparatuses.

FIG. 1 shows another conventional ink cartridge. The ink cartridge of FIG. 1 includes an ink containing part 501 containing ink, a cylindrical case 502 housing the ink containing part 501, and a lid member 503 covering the front side (opening) of the cylindrical case 502. The ink containing part 501 is integrated with a holding member 504 to which a sealed cylindrical ink filling opening 505 for filling the ink containing part 501 with ink and a cylindrical ink supply opening 506 for supplying ink are provided. The holding member 504 is pushed into the cylindrical case 502 so that projections 504*a* of the holding member 504 engage engagement holes 502*a* formed on the wall surface of the cylindrical case 502. As a result, the holding member 504 is fixed and held to the cylindrical case 502. The lid member 503 is fitted into the opening of the cylindrical case 502.

Recent ink-jet recording apparatuses tend to consume more ink as higher image quality is achieved. Therefore, in the recent ink-jet recording apparatuses, a small sub tank is mounted on a carriage so that ink is supplied to the small sub tank from a main ink cartridge provided to the apparatus main body. This is because a conventional type of ink-jet recording apparatus in which cartridges are mounted on a carriage requires frequent replacement of cartridges.

Accordingly, ink cartridges have become larger in size, and if the ink cartridges should be disposed of directly after use as the above-described ink cartridge disclosed in Prior Art 1, it is a huge waste of resources. Therefore, it is necessary that ink cartridges be effectively reusable.

The ink cartridge of Prior Art 2 simply houses an ink reservoir in a chassis so that the ink reservoir is insertable into and extractable from the chassis. According to this configuration, however, the ink reservoir remains unstable, thus preventing a stable supply of ink. In the case of inserting the ink cartridge into the main body of an apparatus from its upper side so that the ink cartridge is loaded into the apparatus with the ink supply opening of the ink cartridge facing downward, the ink reservoir is stabilized to some extent in the chassis. However, in the case of inserting the ink cartridge into the main body of the apparatus from its front side so that the ink cartridge is loaded with its ink supply opening facing in a sideward (horizontal) direction (hereinafter, this configuration is referred to as a front loading configuration), the ink reservoir is inclined in the chassis. Accordingly, it is impossible to employ the front loading configuration with such an ink cartridge.

Further, in the case of the ink cartridge of FIG. 1, the holding member 504 holding the ink containing part 501 has to be pushed into or extracted from the cylindrical case 502 through its opening that is substantially equal in size to the holding member 504. Therefore, the ink cartridge is assembled or disassembled with poor operability. Further, in the case of pouring ink into the ink reservoir, stability is not maintained if the ink reservoir is extracted from the chassis 502. On the other hand, if the ink reservoir is placed in the chassis 502, it is impossible to check the condition of the ink bag 501 while pouring ink into the ink reservoir.

Further, the ink-jet recording apparatuses have been widely used for business purposes because of their increasing processing speed. Therefore, it is required to reduce costs per print, which has been realized by increasing the capacity of an ink cartridge.

However, users who print out a relatively small number of prints and thus consume a small quantity of ink cannot use up ink in the ink cartridge of a large capacity before a recommended expiration date of the ink. As a result, the ink may deteriorate over time to cause ejection instability. Further, the unit purchase price of ink cartridges rises, so that an ink cartridge generally coming with the purchase of an apparatus also becomes expensive, thus placing a burden on users.

Moreover, in order to improve the assemblability and disassemblability of an ink cartridge, to make it possible to check the condition of an ink bag, and to make the front loading configuration employable, a dividable housing may be proposed for an ink cartridge. In the case of employing a dividable housing, however, the rigidity of the housing is reduced.

DISCLOSURE OF THE INVENTION

Accordingly, it is a general object of the present invention to provide an ink cartridge in which the above-described disadvantages are eliminated.

A more specific object of the present invention is to provide an ink cartridge that can hold an ink containing part in the front loading configuration, a housing for the ink cartridge, an ink bag that can be held stably in and extracted easily from the housing of the ink cartridge in the front loading configuration, and an ink-jet recording apparatus employing the ink cartridge.

Another more specific object of the present invention is to provide an ink container for a single color loadable into an image-forming apparatus irrespective of its shape, an image-forming apparatus to which this ink container is attachable, an ink container having a dividable housing with increased rigidity, and an image-forming apparatus to which this ink container is attachable.

One or more of the above objects of the present invention are achieved by an ink cartridge including: an ink containing part including a holding member with an ink supply opening part and a sealed ink filling opening part; a first housing including a holding part holding the holding member of the ink containing part; a second housing whose outline is analogous to an outline of the first housing; and a third housing fitted to a side of an assembly of the first and second housings from which side ink is supplied, wherein the first, second, and third housings are assemblable and disassemblable.

According to the above-described ink cartridge, the first, second, and third housings are assemblable and disassemblable. Accordingly, it is easy to replace the ink containing part.

One or more of the above objects of the present invention are also achieved by an ink cartridge housing for containing an ink containing part, including: a first housing including a holding part holding a holding member provided to the ink containing part; a second housing whose outline is analogous to an outline of the first housing; and a third housing fitted to a side of an assembly of the first and second housings from which side ink is supplied, wherein the first, second, and third housings are assemblable and disassemblable.

According to the above-described ink cartridge housing, the first, second, and third housings are assemblable and disassemblable. Accordingly, it is easy to replace the ink containing part. Further, it is possible to house the ink containing part with stability. Therefore, it is possible to supply ink stably.

One or more of the above objects of the present invention are also achieved by an ink bag sealing ink therein, the ink bag being housed in a housing of an ink cartridge, the ink bag including: a bag-like part formed of a member including an aluminum laminate film; and a holding member including an ink supply opening part and a sealed ink filling opening part, wherein the ink bag engages and is held by an engagement and holding part provided to the housing of the ink cartridge, the housing being an ink cartridge according to the present invention.

The above-described ink bag can be housed stably in the ink cartridge. Further, a last-minute check of the holding state of the ink bag can be done before assembling the first, second, and third housings.

One or more of the above objects of the present invention are also achieved by an ink-jet recording apparatus into which an ink cartridge containing an ink containing part is loadable from a front side thereof, wherein the ink cartridge is an ink cartridge according to the present invention.

According to the above-described ink-jet recording apparatus, an ink cartridge according to the present invention is loaded into the recording apparatus with the front loading configuration. Accordingly, it is possible to replace only the ink bag when the ink of the ink cartridge is used up, and it is also possible to supply ink stably.

One or more of the above objects of the present invention are also achieved by an ink container attachable replaceably to an ink container loading part of an image-forming apparatus, including a positioning part defining a positional relationship between the ink container and an ink introduction part provided to the ink container loading part.

The above-described ink container includes a positioning part defining a positional relationship between the ink container and an ink introduction part provided to the ink container loading part. Therefore, a plurality of versions of the ink container containing the same color ink but having different shapes are attachable to an image-forming apparatus.

One or more of the above objects of the present invention are also achieved by an image-forming apparatus, including an ink container loading part to which an ink container is replaceably attachable, wherein the ink container loading part includes a positioning part for loading ink containers that contain ink of a single color and have different shapes.

The above-described image-forming apparatus has a positioning part for loading ink containers that contain ink of a single color and have different shapes. Therefore, ink containers containing ink of a single color and having different shapes are attachable to the image-forming apparatus.

One or more of the above objects of the present invention are also achieved by an ink container, including a dividable housing that houses an ink bag containing ink, wherein at least one screw member is employable as a fastening member to keep the dividable housing in an assembled state.

The above-described ink container employs at least one screw member as a fastening member to keep the dividable housing in an assembled state. Accordingly, the ink containing part (ink bag) of the ink container can be replaced easily. Further, the ink containing part can be housed stably so that ink can be supplied stably. Further, the rigidity of the housing can be increased.

One or more of the above objects of the present invention are further achieved by an image-forming apparatus, including an ink container loading part to which an ink container is replaceably attachable, wherein the ink container includes a dividable housing that houses an ink bag containing ink, wherein at least one screw member is employable as a fastening member to keep the dividable housing in an assembled state.

According to the above-described image-forming apparatus, stable ink supply is performable.

BRIEF DESCRIPTION OF THE DRAWINGS

Other objects, features and advantages of the present invention will become more apparent from the following detailed description when read in conjunction with the accompanying drawings, in which.

BEST MODE FOR CARRYING OUT THE INVENTION

A description is given, with reference to the accompanying drawings, of embodiments of the present invention.

Figure 2:
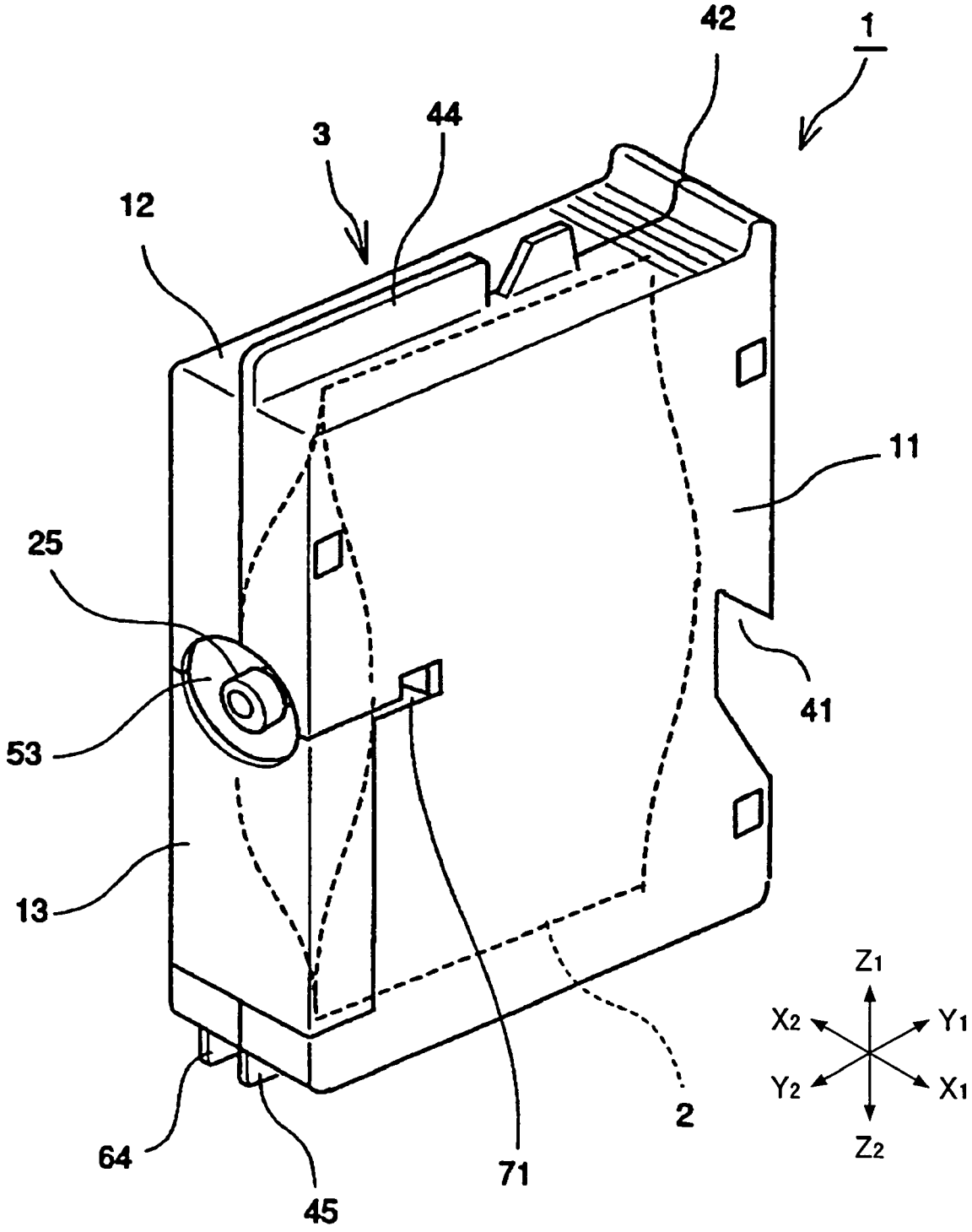
FIG. 2 is a perspective view of an ink cartridge according to a first embodiment of the present invention.

FIG. 2 is a perspective view of an ink cartridge 1, which is an ink container, according to a first embodiment of the present invention. Referring to FIG. 2, the ink cartridge 1 includes an ink bag 2, which is an ink containing part, and a housing 3 for housing the ink bag 2. The housing 3 includes a first housing part 11, a second housing part 12, and a third housing part 13. The first and second housing parts 11 and 12 form a housing part that protects the $X_1$ and $X_2$ sides of the ink bag (ink containing part) 2. That is, the housing 3 is divided into the first and second housing parts 11 and 12 housing the ink containing part 2 along a plane parallel to the direction in which ink is supplied (an ink supply direction).

Figure 3:
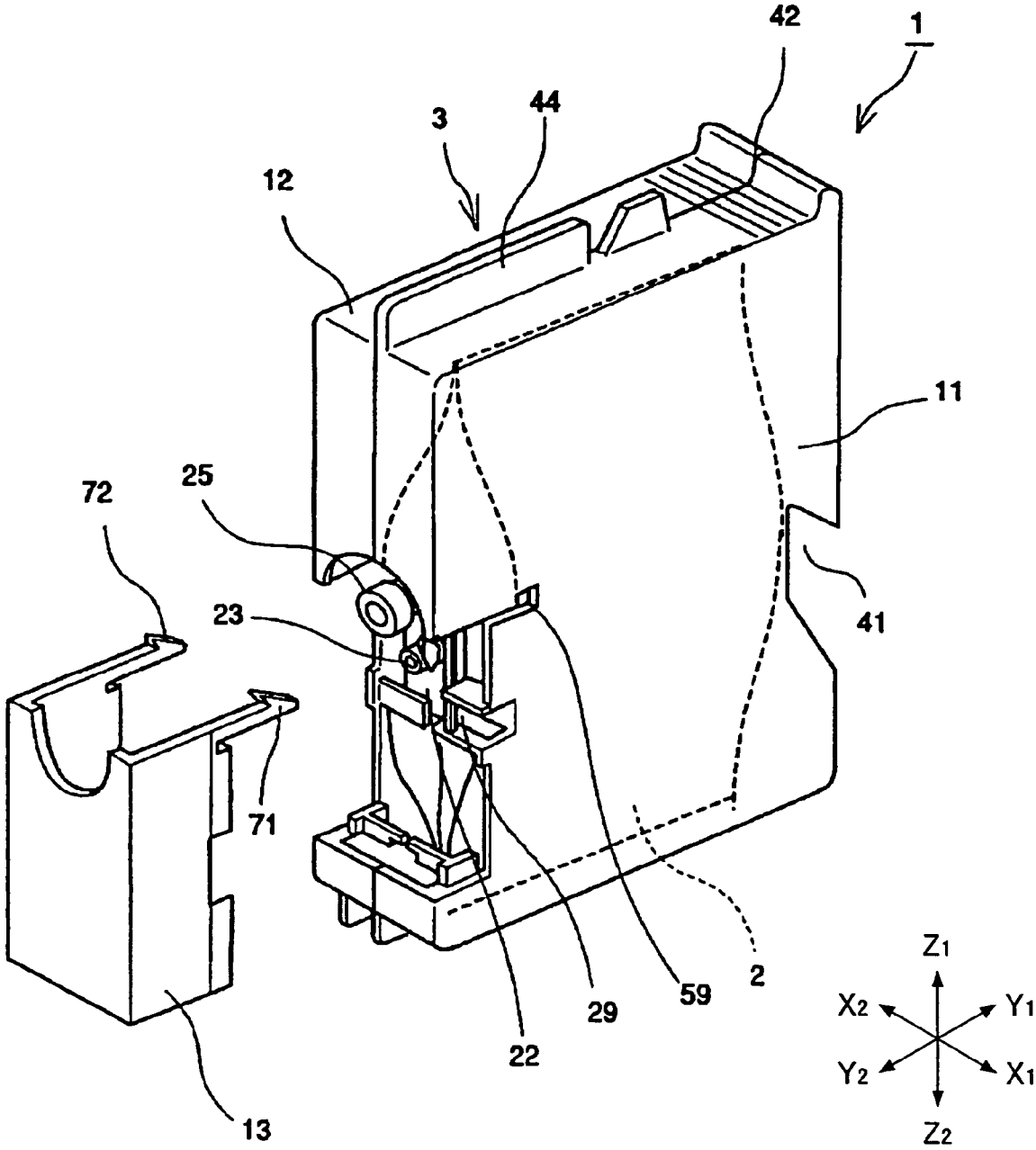
FIG. 3 is a perspective view of the ink cartridge from which a third housing part is detached according to the first embodiment of the present invention.
Figure 4:
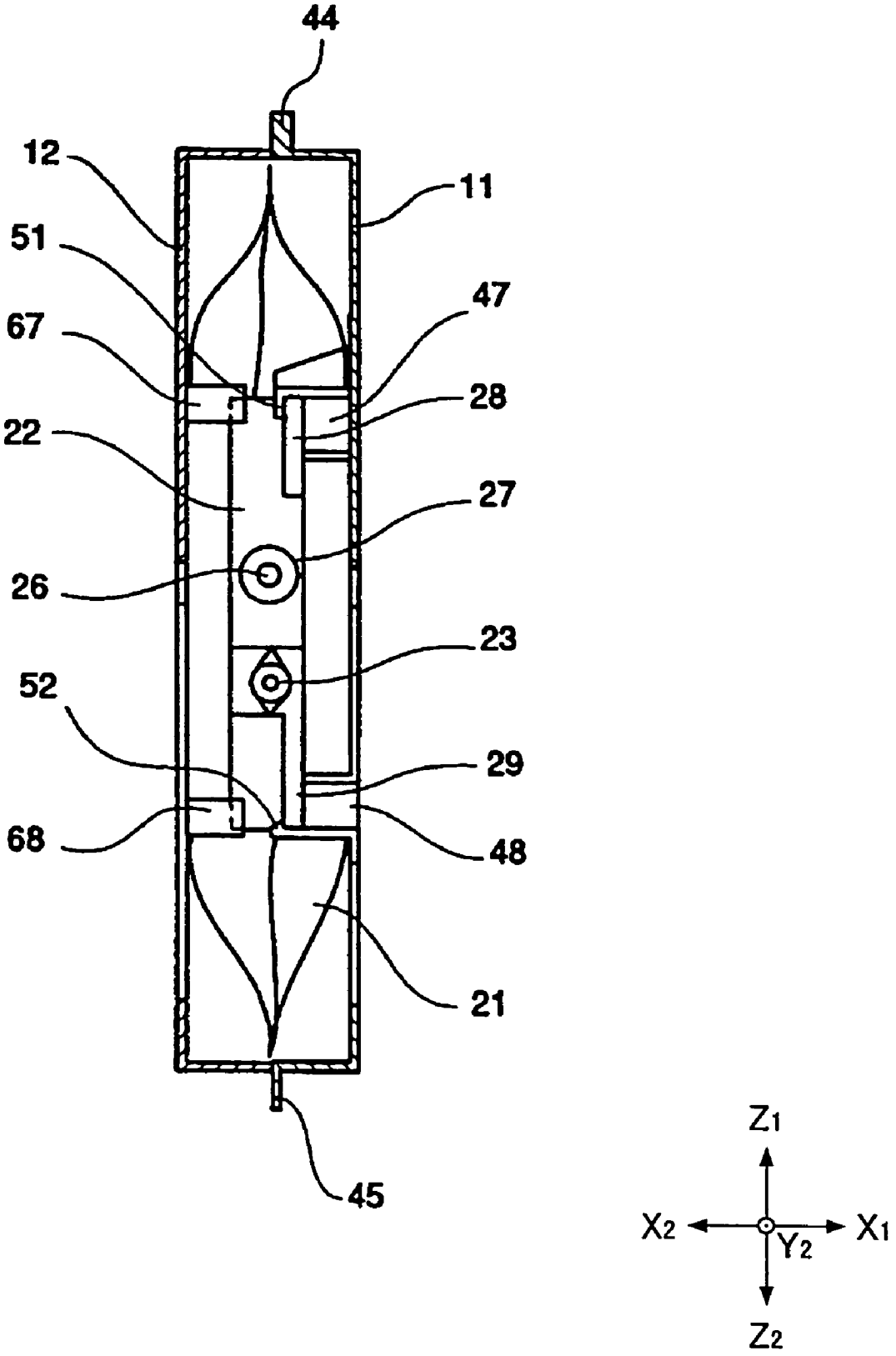
FIG. 4 is a cross-sectional front view of the ink cartridge according to the first embodiment of the present invention.
Figure 6:
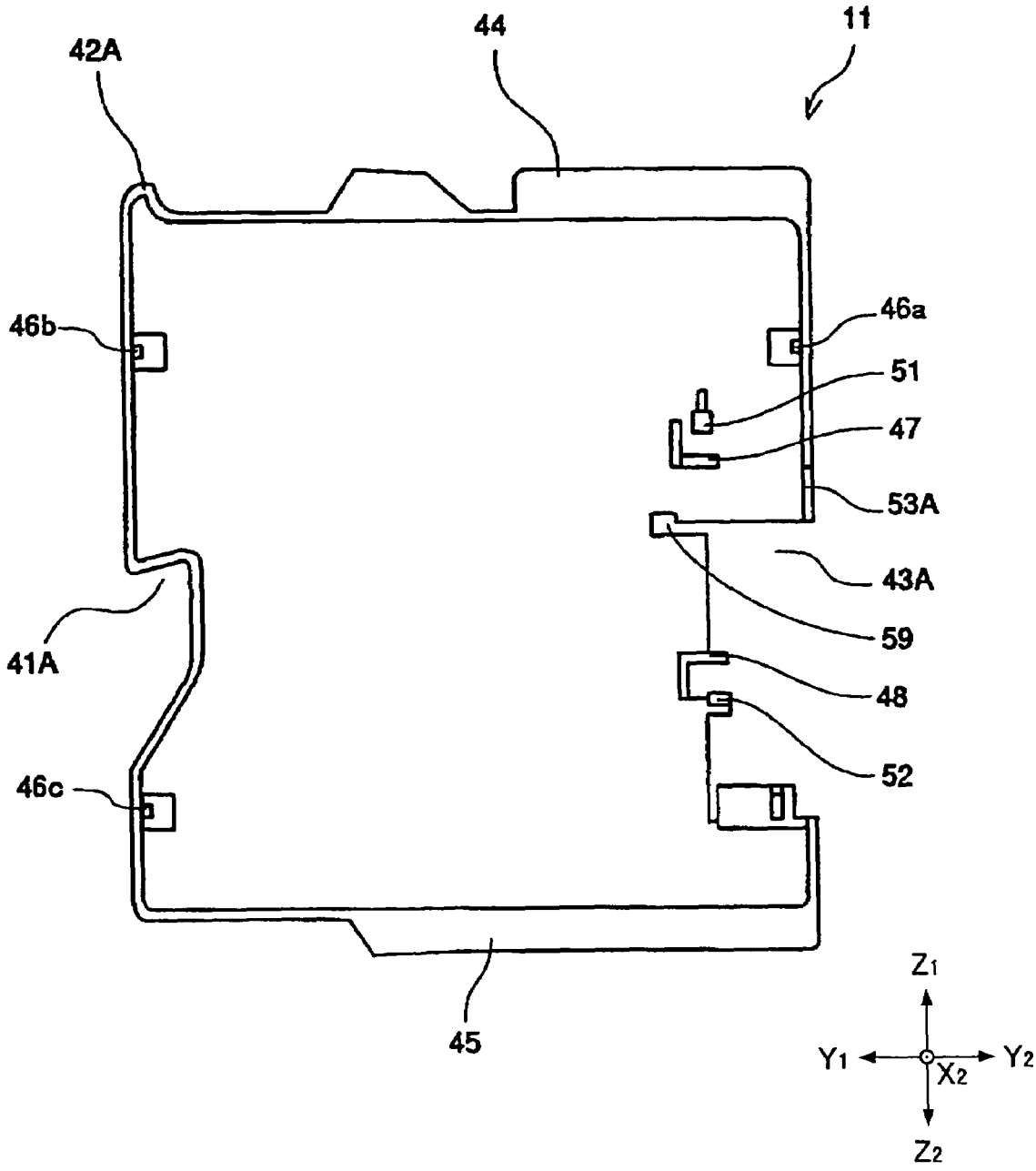
FIG. 6 is a side view of a first housing part of the ink cartridge according to the first embodiment of the present invention.
Figure 7:
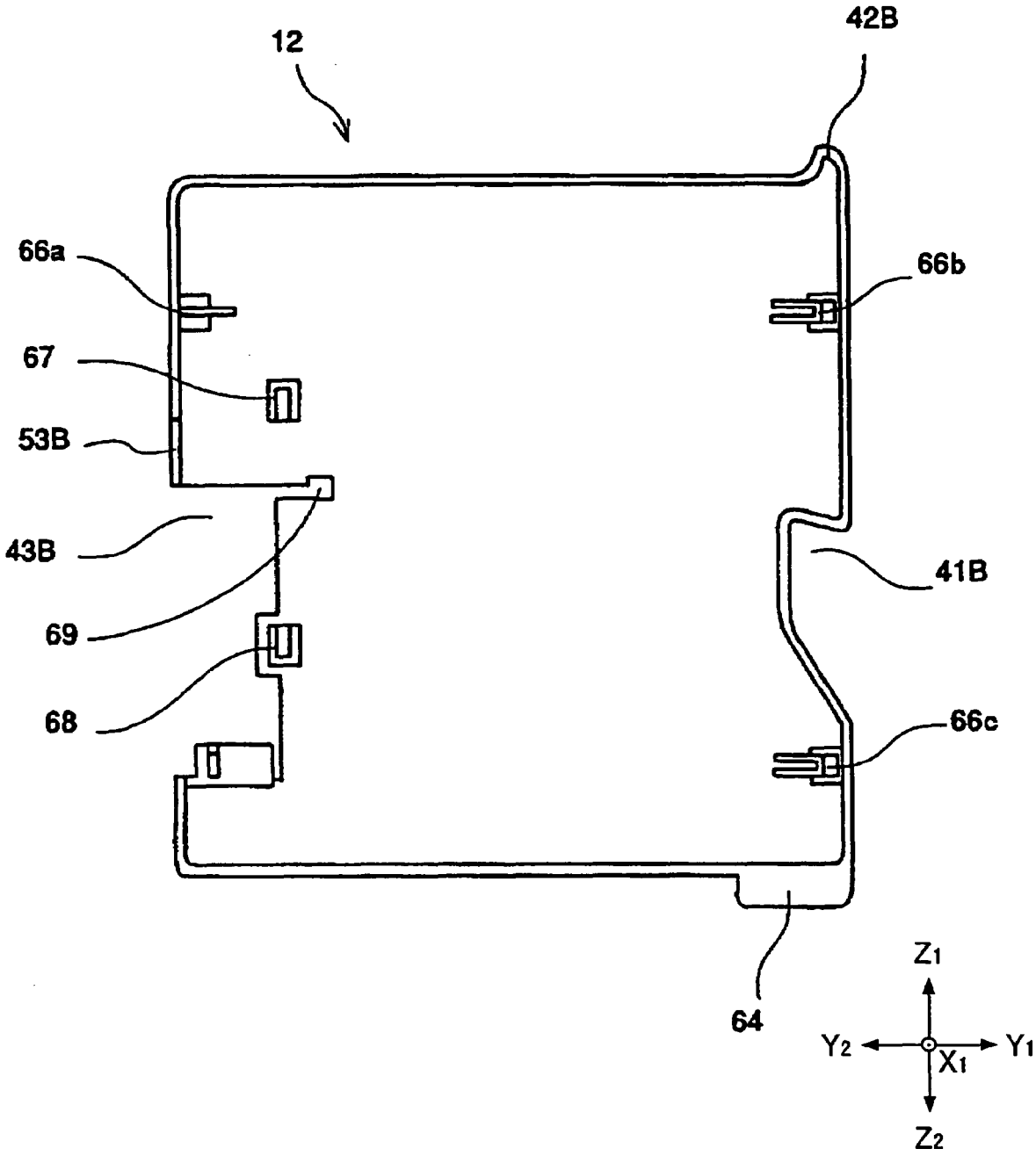
FIG. 7 is a side view of a second housing part of the ink cartridge according to the first embodiment of the present invention.

FIG. 3 is a perspective view of the ink cartridge 1 from which the third housing part 13 is detached. FIG. 4 is a cross-sectional front view of the ink cartridge 1. FIGS. 5A through 5D are diagrams for illustrating the ink bag 2. FIG. 6 is a side view of the first housing part 11. FIG. 7 is a side view of the second housing part 12.

Figure 5A:
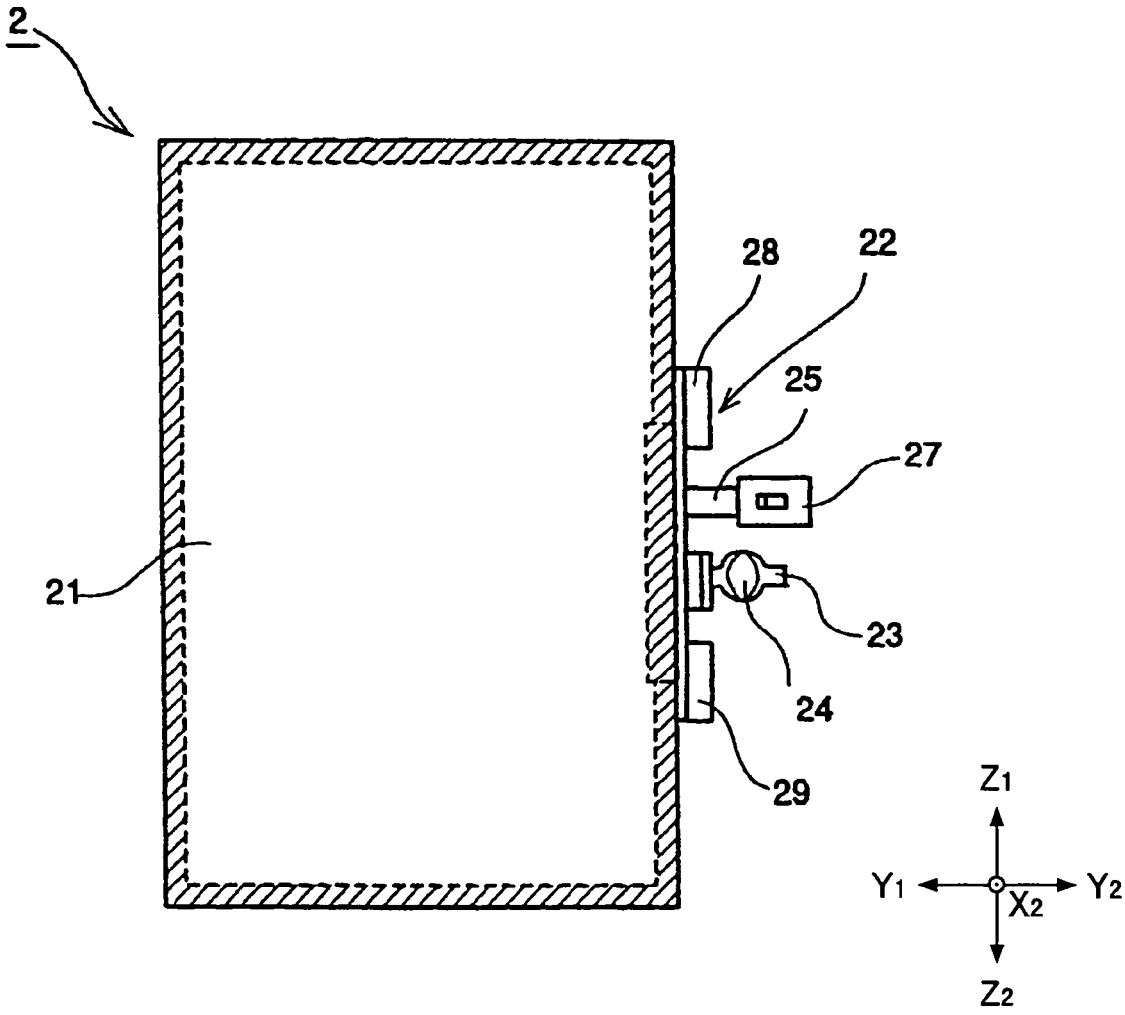
FIG. 5A is a side view of an ink bag included in the ink cartridge.
Figure 5B:
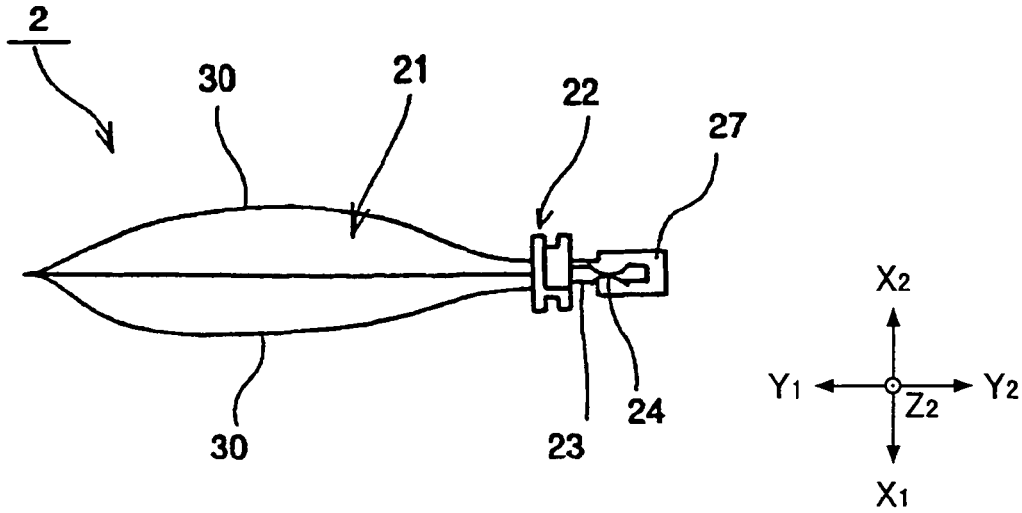
FIG. 5B is a bottom view of the ink bag for illustrating a state of the ink bag filled with ink.

Referring to FIGS. 5A and 5B, the ink bag 2 includes a bag-like part 21 having a substantially quadrilateral (rectangular in this embodiment) outline and a holding member 22 to which the bag-like part 21 is fixed. The bag-like part 21 is formed of an aluminum laminate film and has flexibility. The holding member 22 is made of resin. The outline of the bag-like part 21 on the $X_2$ ($X_1$) side is not limited to a rectangle, but may be substantially circular or substantially elliptic. The bag-like part 21 is not required to have a specific outline on the $X_2$ ($X_1$) side.

Figure 5C:
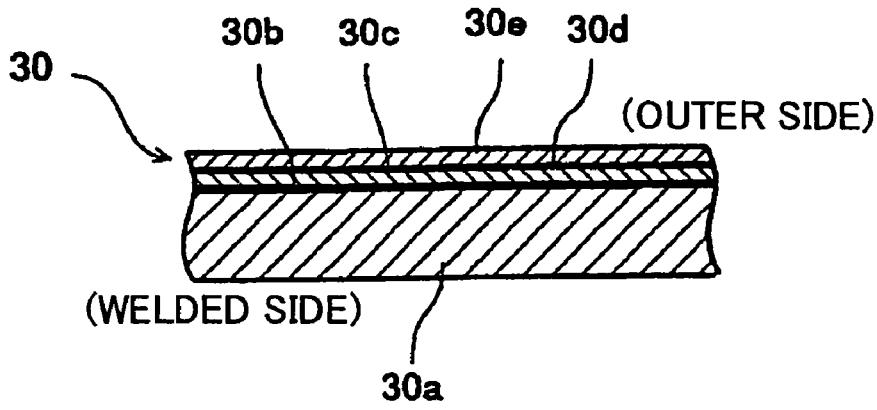
FIG. 5C is a sectional view of an aluminum laminate film forming a main body of the ink bag.

The bag-like part 21 employs an aluminum laminate film 30 of a layer structure formed by stacking a dry lamination 30*b*, an aluminum film 30*c*, a dry lamination 30*d*, and a PA 30*e* successively on an LDPE 30*a* as shown in FIG. 5C. The bag-like part 21 may also employ an aluminum laminate film of another structure. As shown in FIGS. 5A and 5B, the two aluminum laminate films 30 have their respective peripheral edges (shown by hatching in FIG. 5A) welded to each other and to the holding member 22 so as to be formed into a bag-like shape, thereby forming the bag-like part 21.

The bag-like part 21 dispenses with an internal frame body conventionally employed to maintain its shape, and has flexibility as a whole. Accordingly, the amount of ink to be left over in the bag-like part 21 is substantially reduced. Further, the material of a member forming the bag-like part 21 is not limited to an aluminum laminate film. It is preferable, however, to make the bag-like part 21 of a member including at least an aluminum laminate film.

The holding member 22 is integrated with a cylindrical opening (ink filling opening) part 23 used for filling the bag-like part 21 with ink. A through hole is formed inside the cylindrical opening part 23. The ink filling opening part 23 includes a sealing part 24 that is formed by melting a middle portion of the ink filling opening part 23 to seal the internal through hole thereof.

Figure 5D:
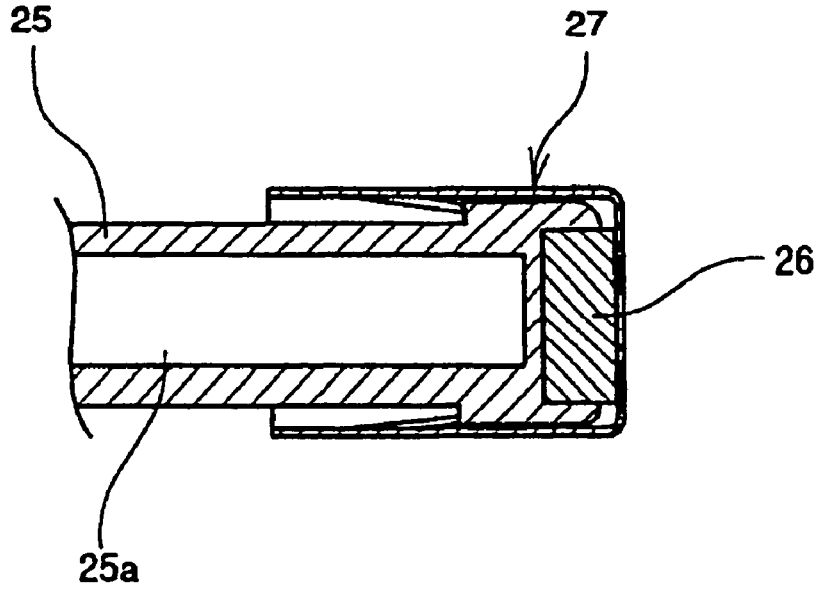
FIG. 5D is a sectional view of an ink supply opening part of the ink bag according to the first embodiment of the present invention.

Further, referring to FIG. 5D, the holding member 22 is also integrated with a cylindrical opening (ink supply opening) part 25 for supplying ink from inside the bag-like part 21 to an ink-jet recording apparatus. A through hole 25*a* is formed inside the cylindrical opening part 25. A cap member 27 holding an elastic body 26 such as rubber inside is fitted to the end of the ink supply opening part 25. A hollow supply needle (hollow needle), which is an ink introduction part, is stuck into the elastic body 26 from the main body side of the recording apparatus so as to allow ink to be supplied to the main body side of the recording apparatus with the sealed state of the bag-like part 21 being maintained.

Figure 1:
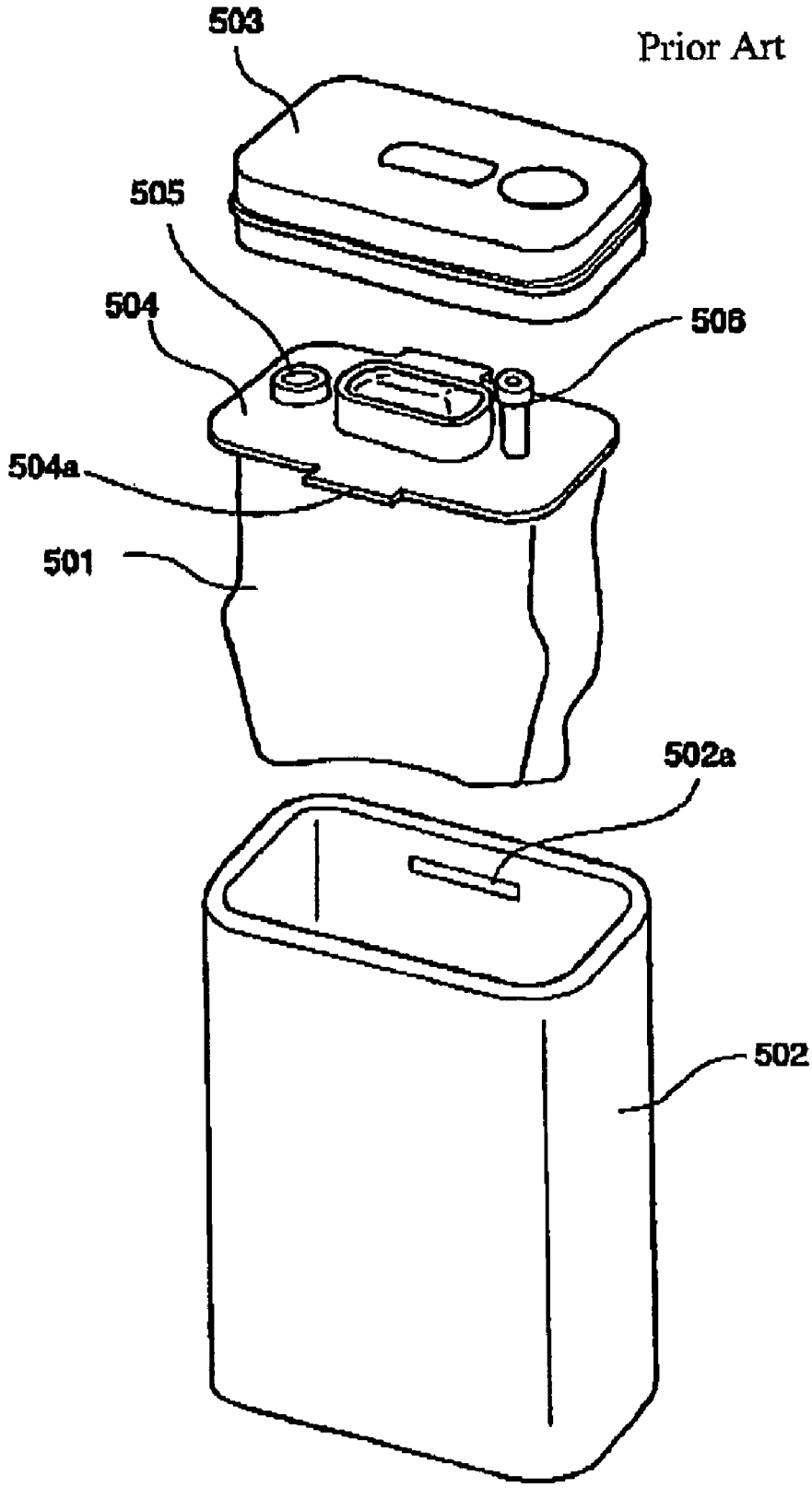
FIG. 1 is an exploded perspective view of a conventional ink cartridge.

Referring to FIG. 5A, the ink supply opening part 25 is provided substantially in the center of the ink bag 2 in the vertical ($Z_1$ or $Z_2$) direction. Accordingly, in the case of using the ink cartridge 1 in the upright position (shown in FIG. 2), ink flows smoothly in the bag-like part 21 of the ink bag 2 compared with the case where an ink outlet is provided in a position offset from the center to an end of an ink bag as shown in FIG. 1. As a result, it can be ensured that ink in the bag-like part 21 is substantially used up.

Further, the holding member 22 is integrated with engagement projections 28 and 29 to engage engagement claws 51 and 52 (FIGS. 4 and 6), respectively, of the first housing part 11.

With reference to the ink bag 2 thus formed by joining the two flexible films 30, the housing 3 of the ink cartridge 1 includes the first and second housings 11 and 12 that are separable in the direction of thickness of the flexible films 30 forming the ink bag 2 that is an ink containing part.

Referring to FIGS. 2 and 3, the divided first and second housing parts 11 and 12 substantially analogous to each other are combined, and the third housing part 13 is fitted into a lower part of the front ($Y_2$) side of the combined first and second housing parts 11 and 12. As a result, the first through third housing parts 11 through 13 are assembled into the housing 3 of a substantially rectangular parallelepiped shape. As is described below, when the housing 3 is assembled, a recess 41 and a projecting part (a handle part) 42 are formed on the rear ($Y_1$) side of the housing 3, and an opening 53 is formed on the front ($Y_2$) side of the housing 3 so as to face the ink supply opening part 25 supplying ink to the main body of the recording apparatus. The recess 41 and the projecting part 42 are formed to help fingers catch the housing 3 easily in attaching the ink cartridge 1 to or detaching the ink cartridge 1 from the main body of the recording apparatus.

Referring to FIG. 6, the first housing part 11 has a substantially rectangular outline on the $X_2$ ($X_1$) side. A half recess 41A, a half projecting part 42A, a cutout 43A, and guide parts 44 and 45 are formed integrally with the first housing part 11 on its periphery. The half recess 41A is substantially half of the recess 41. The half projecting part 42A is substantially half of the projecting part 42. The cutout 43A is provided to form a space that an ink filling apparatus can enter to fill ink into the ink bag 2 held between the first and second housing parts 11 and 12. The guide parts 44 and 45 are used to load the ink cartridge 1 into the main body of the recording apparatus and the ink filling apparatus.

Further, engagement parts 46*a*, 46*b*, and 46*c* to engage engagement claws 66*a*, 66*b*, and 66*c* (FIG. 7), respectively, of the second housing part 12 are formed on the inner wall face of the first housing part 11 at three corners thereof. Further, positioning parts 47 and 48 that determine a position at which the holding member 22 of the ink bag 2 engages and is fastened to and held by the first housing part 11, and the above-described engagement claws 51 and 52 that engage and are fastened to the engagement projections 28 and 29, respectively, of the holding member 22 are provided on the inner wall face of the first housing part 11. The positioning parts 47 and 48 and the engagement claws 51 and 52 form an engagement and holding part that engages and holds the holding member 22 of the ink bag 2.

Further, an approximately quarter-circle arc part 53A for forming part of the opening 53 is formed on the front ($Y_2$) side of the first housing part 11. The front side refers to a leading side in the case of loading the ink cartridge 1 into the main body of the recording apparatus. That is, the ink cartridge 1 is loaded into the main body of the recording apparatus with the $Y_2$ side facing the main body of the recording apparatus.

Further, an engagement recess 59 to engage an engagement claw 71 of the third housing part 13 when the third housing part 13 is fitted into the first and second housing parts 11 and 12 is provided to the first housing part 11.

Next, referring to FIG. 7, the second housing part 12 has an outline substantially analogous to that of the first housing part 11. A half recess 41B, a half projecting part 42B, a cutout 43B, and an identification part 64 are formed on the periphery of the second housing part 12. The half recess 41B is substantially half of the recess 41. The half projecting part 42B is substantially half of the projecting part 42. The cutout 43B is provided to form the space into which the ink filling apparatus can enter to fill ink into the ink bag 2 held between the first and second housing parts 11 and 12. The identification part 64 represents the color of ink filling the ink bag 2 of the ink cartridge 1.

The engagement claws 66*a*, 66*b*, and 66*c* to engage and be caught by the engagement parts 46*a*, 46*b*, and 46*c*, respectively, of the first housing part 11 are formed integrally with the second housing part 12 on its inner wall face at three corners. Further, fitting parts 67 and 68 having grooves into which the holding member 22 of the ink bag 2 is fitted are formed on the inner wall face of the second housing part 12.

Further, an approximately quarter-circle arc part 53B for forming the opening 53 is formed on the front ($Y_2$) side of the second housing part 12. The front side refers to a leading side in the case of loading the ink cartridge 1 into the main body of the recording apparatus.

Further, an engagement recess 69 to engage an engagement claw 72 of the third housing part 13 when the third housing part 13 is fitted into the first and second housing parts 11 and 12 is provided to the second housing part 12.

Referring to FIG. 3, the third housing part 13 is fitted into the cutouts 43A and 43B formed on the front ($Y_2$) side of the combined first and second housing parts 11 and 12. The front side may be referred to as an ink supply side because ink is supplied to the main body of the recording apparatus from the front side of the housing 3 or the ink cartridge 1. The third housing part 13 includes the engagement claws 71 and 72 to engage the engagement recesses 59 and 69 of the first and second housing parts 11 and 12, respectively. Further, an approximately half-circle arc part 53C for forming the opening 53 is provided to the third housing part 13.

Figure 8:
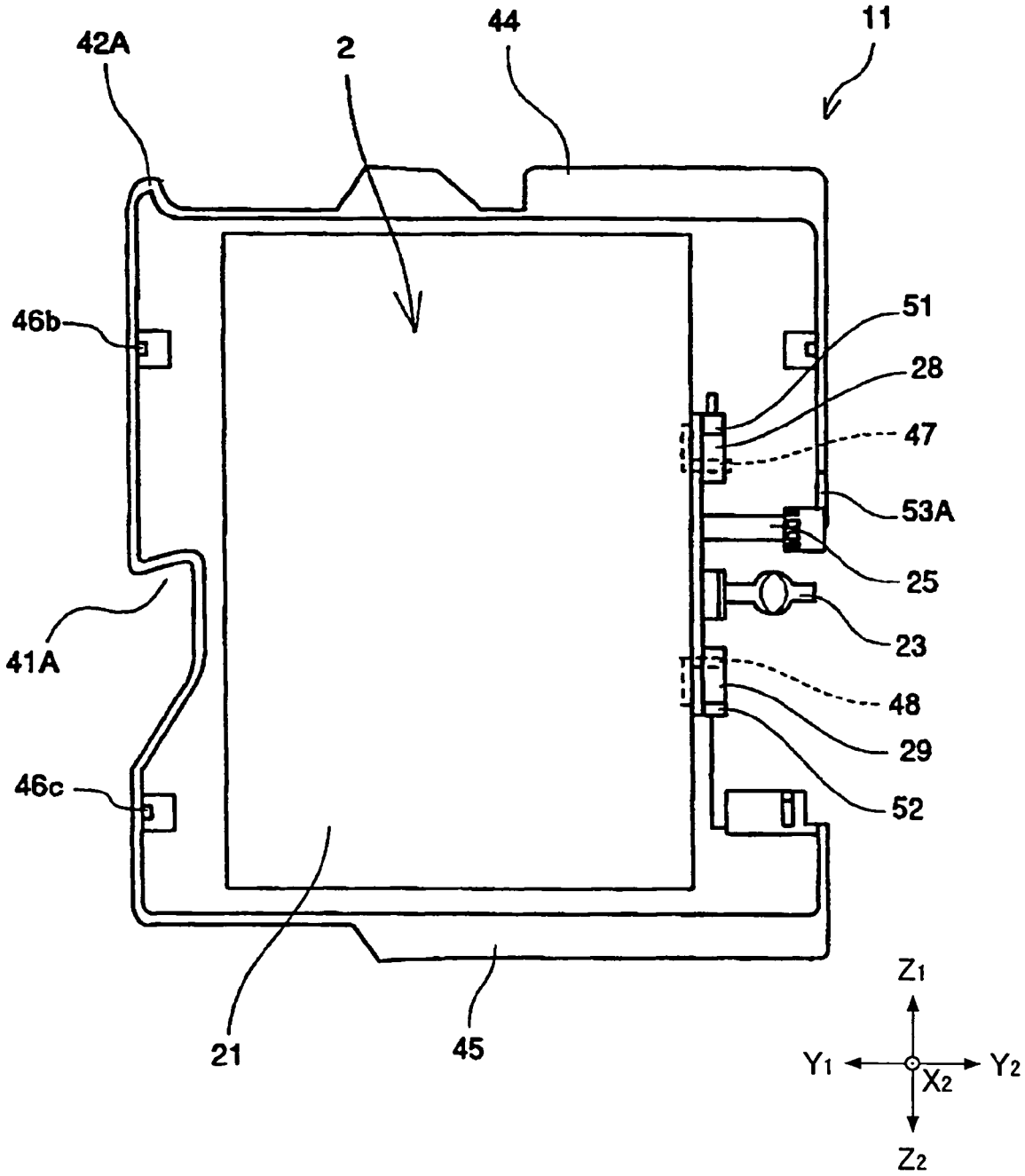
FIG. 8 is a side view of the first housing part engaging and holding the ink bag according to the first embodiment of the present invention.

Referring to FIG. 8, in the case of assembling the ink cartridge 1 having the above-described configuration, the holding member 22 of the ink bag 2 is pressed against the positioning members 47 and 48 of the first housing part 11 while being positioned by the positioning members 47 and 48. As a result, the engagement claws 51 and 52 of the first housing part 11 engage and hold the engagement projections 28 and 29, respectively, of the holding member 22 of the ink bag 2. Consequently, the holding member 22 engages and is held by the first housing part 11.

Thereafter, the second housing part 12 is superimposed on the first housing part 11, and the first and second housing parts 11 and 12 are pressed against each other from their respective external sides. As a result, the engagement claws 66*a* through 66*c* of the second housing part 12 engage and are held by the engagement parts 46*a* through 46*c*, respectively, of the first housing part 11. Thus, the assembly of the first and second housing parts 11 and 12 shown in FIG. 3 is formed.

Then, as shown in FIG. 3, the third housing part 13 is fitted into the assembly of the first and second housing parts 11 and 12. As a result, the engagement claws 71 and 72 of the third housing part 13 engage the engagement recesses 59 and 69 of the first and second housing parts 11 and 12, respectively. Thus, the ink cartridge 1 shown in FIG. 2 is assembled.

In the case of extracting the ink bag 2 from the ink cartridge 1 and replenishing the ink cartridge 1 with a new ink bag 2, the above-described process is performed in the reverse order. That is, first, the third housing part 13 is detached from the assembly of the first and second housing parts 11 and 12. Then, the first and second housing parts 11 and 12 are disassembled. At this point, the third housing part 13 lightly engages the first and second housing parts 11 and 12 through the engagement claws 71 and 72 and the engagement recesses 59 and 69. Further, the first and second housing parts 11 and 12 lightly engage through the engagement parts 46*a* through 46*c* and the engagement claws 66*a* through 66*c*. Therefore, the third housing part 13 can be easily detached from the first and second housing parts 11 and 12, and the first and second housing parts 11 and 12 can be easily disassembled.

In this case, the engagement claws 71 and 72 may be damaged if the ink cartridge 1 (that is, the third housing part 13) is repeatedly reused. However, the condition of the engagement claws 71 and 72 may be checked by simply detaching the third housing part 13 from the first and second housing parts 11 and 12. Accordingly, if one of the engagement claws 71 and 72 is found to be damaged, the ink cartridge 1 can be disposed of at that point, thus making it possible to reduce the number of operation processes. During initial filling or refilling of the ink bag 2 with ink, the ink bag 2 is held by the first housing part 11. Accordingly, it is possible to pour ink into the ink bag 2 while checking the condition of the ink bag 2. Further, since the ink bag 2 is held by the first housing part 11, it is possible to pour ink into the ink bag 2 while maintaining the ink bag 2 in a stable condition. Furthermore, a last-minute check of the holding state of the ink bag 2 can be done before assembling the housing 3.

Thus, the housing 3 of the ink cartridge 1 includes the first housing part 11 that fixes the holding member 22 of the ink containing part 2, the second housing part 12 having an outline analogous to that of the first housing part 11, and the third housing part 13 that engages the assembly of the first and second housing parts 11 and 12. Further, the first through third housing parts 11 through 13 are assemblable and disassemblable. That is, the first through third housing parts 11 through 13 can be assembled into the housing 3, and the housing 3 can be disassembled into the first through third housing parts 11 through 13. This facilitates replacement of the ink containing part 2. Moreover, the holding member 22 of the ink containing part 2 is held by the first and second separate housing parts 11 and 12. By thus dividing the housing 3 along a plane parallel to the ink supply direction, the position of the ink bag 2 is stabilized even in the front loading configuration. This enables ink to be supplied stably.

The engagement parts 46*a* through 46*c* of the first housing part 11 and the engagement claws 66*a* through 66*c* of the second housing part 12 may be interchanged. Further, the engagement recesses 59 and 69 of the first and second housing parts 11 and 12 and the engagement claws 71 and 72 of the third housing part 13 may be interchanged. That is, the engagement parts 46*a* through 46*c* may be provided to the second housing part 12, and the engagement claws 66*a* through 66*c* may be provided to the first housing part 11. The engagement recesses 59 and 69 may be provided to the third housing part 13, and the engagement claws 71 and 72 may be provided to the first and second housing parts 11 and 12, respectively. Further, in this embodiment, the ink cartridge 1 is held in the upright or vertical position in the front loading configuration. However, the ink cartridge 1 may be held in the flat or lateral position in the front loading configuration.

Next, a description is given, with reference to FIGS. 9 through 14, of variations of the ink cartridge 1 according to the first embodiment of the present invention.

Figure 9:
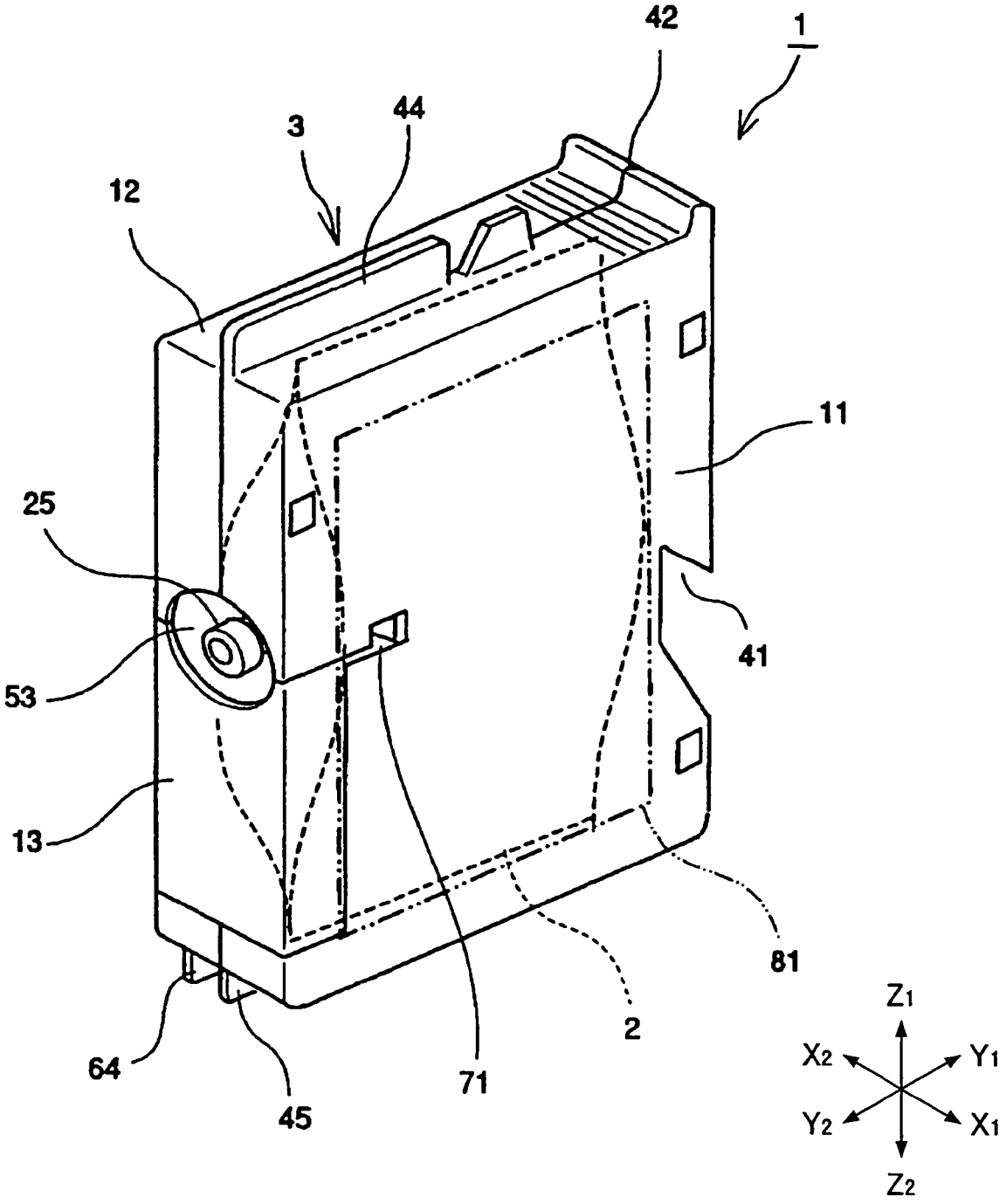
FIG. 9 is a perspective view of a first variation of the ink cartridge according to the first embodiment of the present invention.

FIG. 9 is a perspective view of a first variation of the ink cartridge 1. According to the first variation, a label 81 (indicated by the double-dot chain line) is applied on each of the external $X_1$ side of the first housing part 11 and the external $X_2$ side of the second housing part 12 so as to reinforce the engagement of the engagement claws 71 and 72 of the third housing part 13 with the engagement recesses 59 and 69 of the first and second housing parts 11 and 12. As a result, the third housing part 13 is prevented from falling off even when the ink cartridge 1 is frequently loaded and unloaded.

Figure 10:
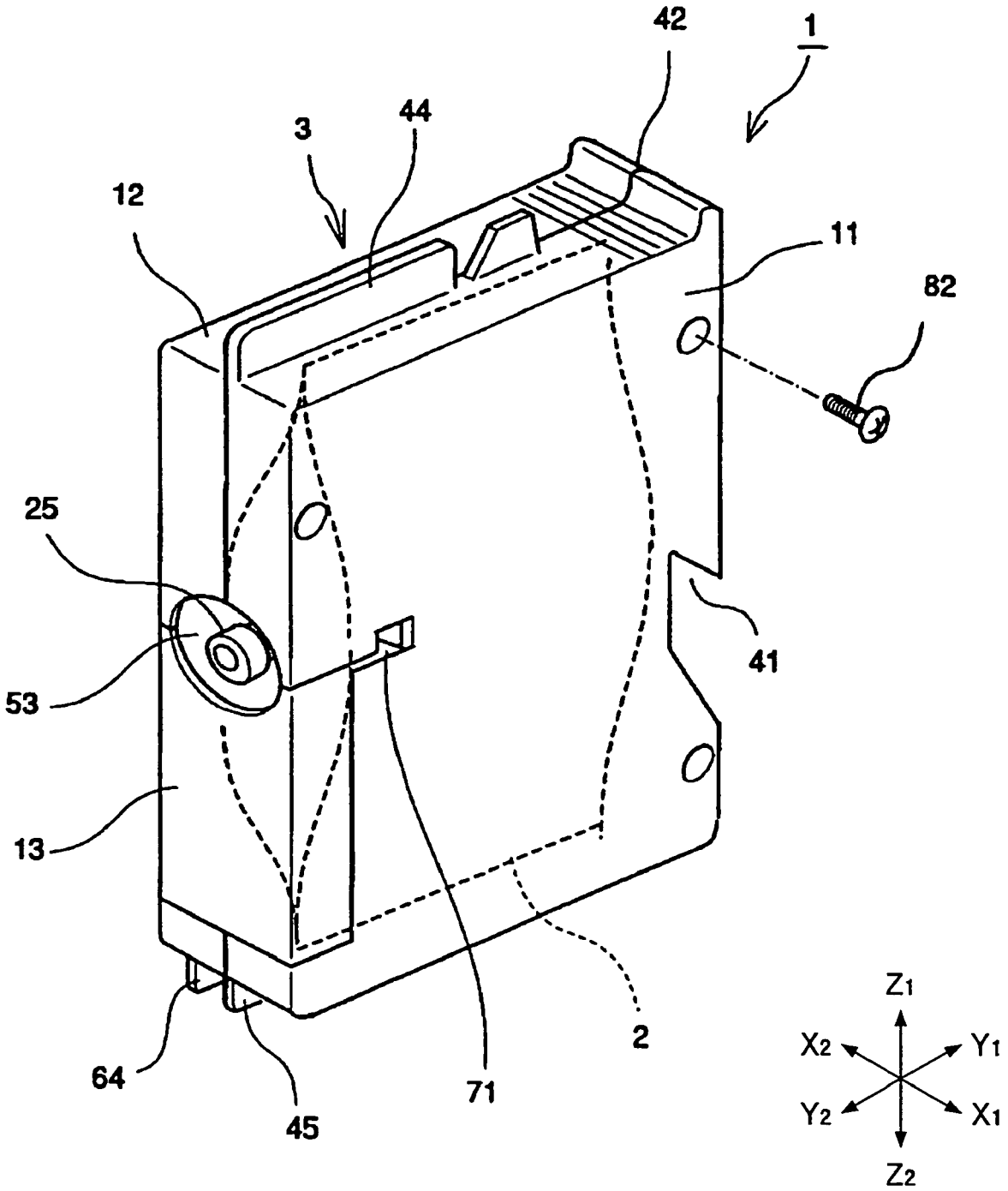
FIG. 10 is a perspective view of a second variation of the ink cartridge according to the first embodiment of the present invention.

FIG. 10 is a perspective view of a second variation of the ink cartridge 1. According to the second variation, the first and second housing parts 11 and 12 are fastened and fixed to each other by screw members 82 (only one of which is shown in FIG. 10). This prevents the spontaneous disassembling of the housing 3 even when the ink cartridge 1 is frequently loaded and unloaded.

Figure 11:
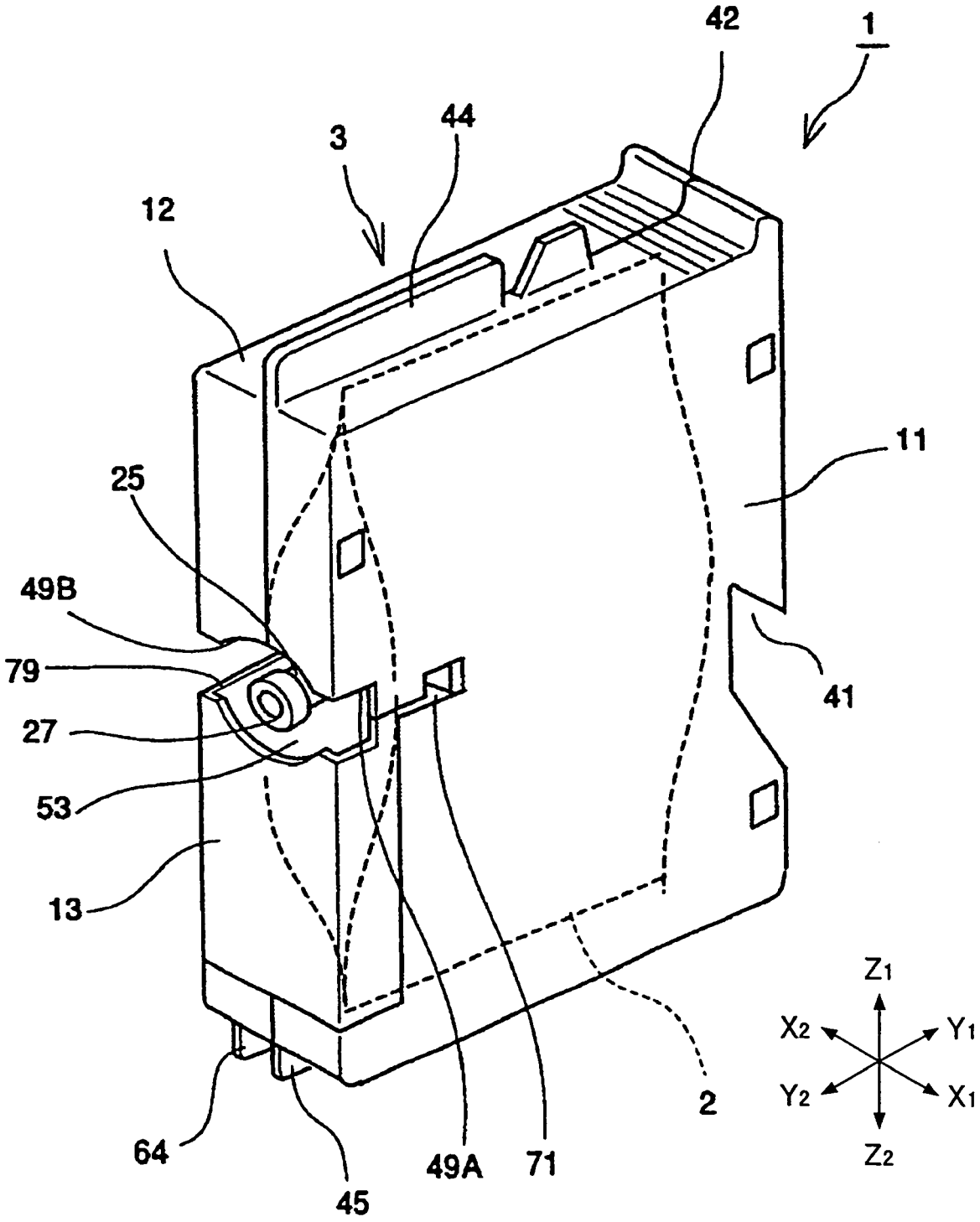
FIG. 11 is a perspective view of a third variation of the ink cartridge according to the first embodiment of the present invention.

FIG. 11 is a perspective view of a third variation of the ink cartridge 1. According to the third variation, cutouts 49A and 49B are formed in the first and second housing parts 11 and 12, respectively, beside the ink supply opening part 25 of the ink bag 2 and/or the cap member 27 provided to the end of the ink supply opening part 25. Further, a cutout 79 is formed in the third housing part 13 beside the ink supply opening part 25 of the ink bag 2 and/or the cap member 27 provided to the end of the ink supply opening part 25.

As a result, in the case of reducing the thickness of the ink cartridge 1 along the X-axis in FIG. 11, a needle guard provided around a needle is prevented from coming in contact with the first, second, or third housing part 11, 12, or 13 when the needle is inserted into the ink supply opening part 25 from the main body side of the recording apparatus.

Figure 12:
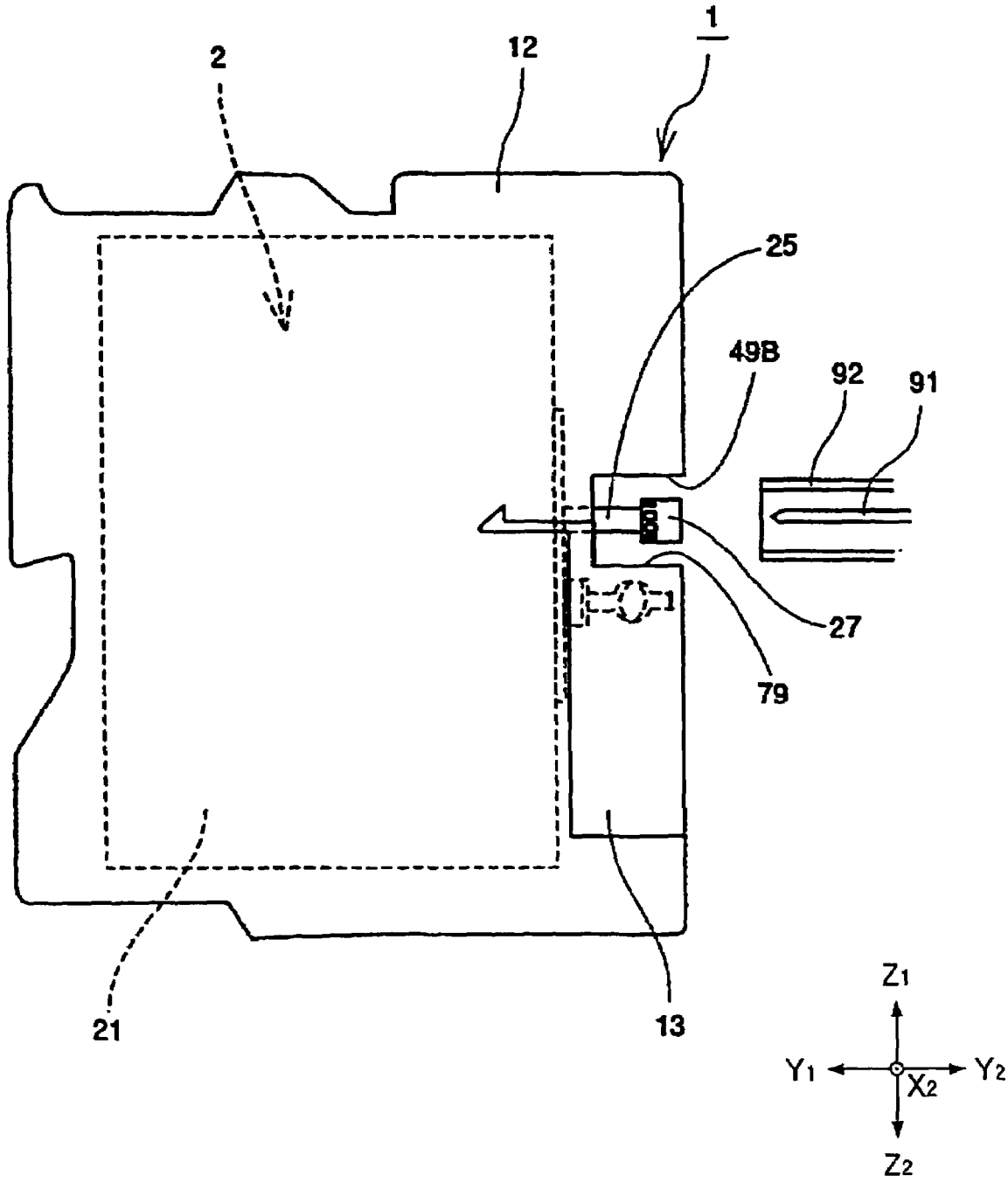
FIG. 12 is a side view of the third variation of the ink cartridge for illustrating the connection of the ink cartridge to an apparatus main body, according to the first embodiment of the present invention.
Figure 13:
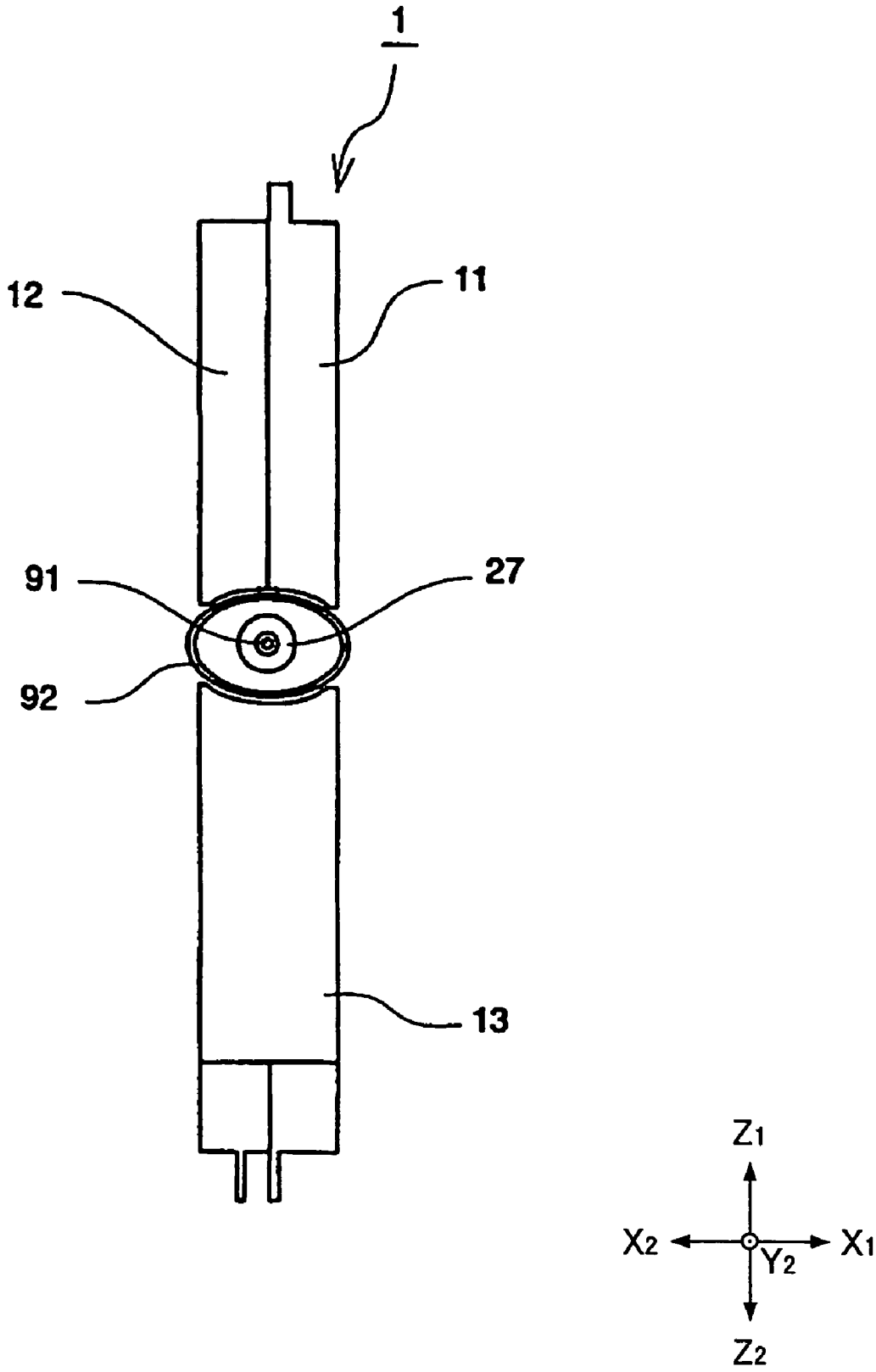
FIG. 13 is a front view of the third variation of the ink cartridge according to the first embodiment of the present invention.

That is, as shown in FIG. 12, a needle 91 is inserted into the ink supply opening part 25 of the ink cartridge 1 from the main body side of the recording apparatus so that the ink supply opening part 25 is connected to the ink supply system of the main body of the recording apparatus. In this case, a needle guard 92 to protect the needle 91 is provided around the needle 91 on the main body side of the recording apparatus. When the thickness of the ink cartridge 1 is reduced, the opening 53 alone cannot provide an opening that the needle guard 92 can enter. Accordingly, the cutouts 49A, 49B, and 79 are formed in the first through third housing parts 11 through 13, respectively, at positions defining the periphery of the opening 53 beside the ink supply opening part 25 of the ink bag 2 and/or the cap member 27 provided to the end of the ink supply opening part 25. As a result, as shown in FIG. 13, the needle guard 92 is allowed to enter without coming into contact with any of the first through third housing parts 11 through 13. That is, it is possible to reduce the thickness of the ink cartridge 1.

Figure 14:
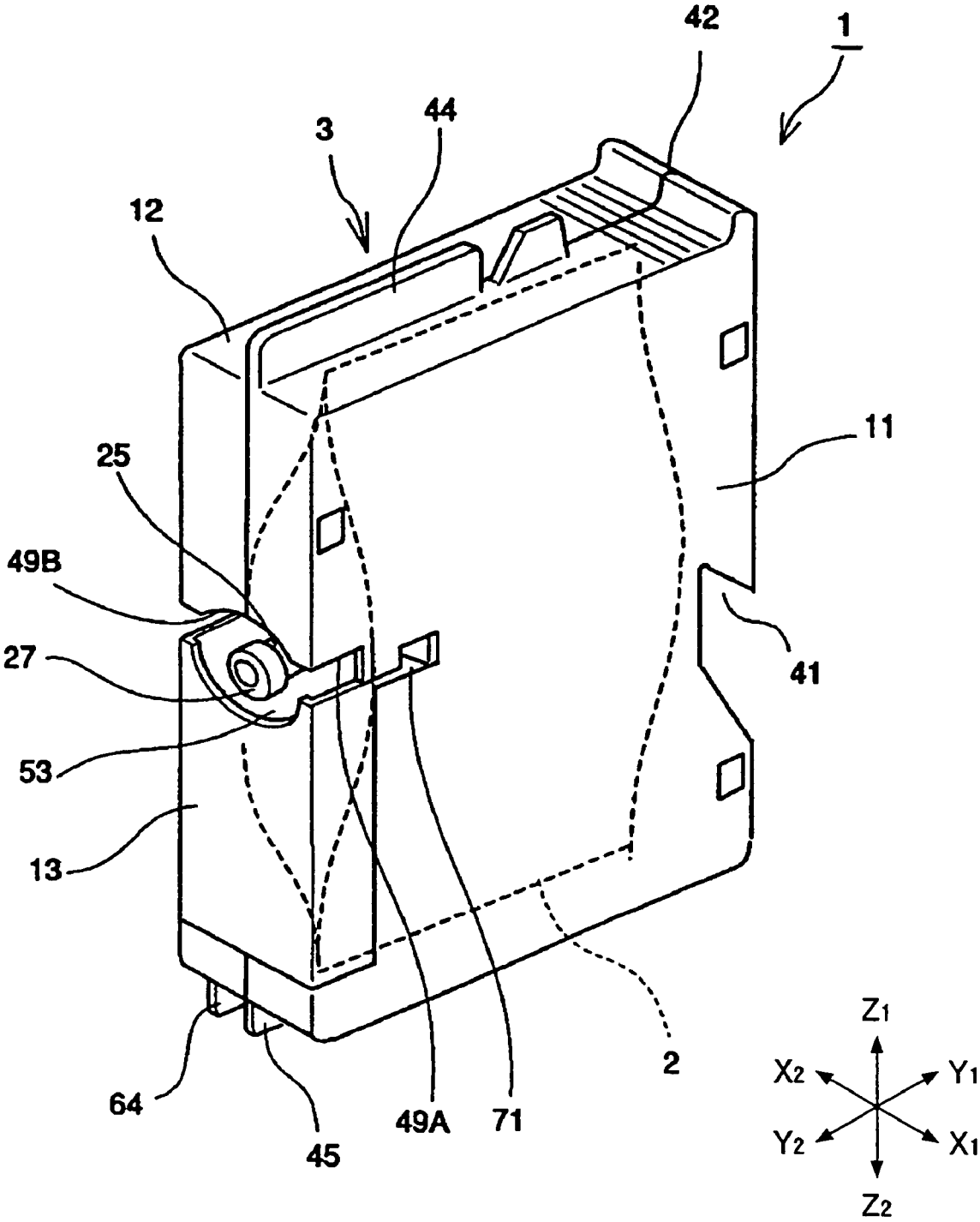
FIG. 14 is a perspective view of a fourth variation of the ink cartridge according to the first embodiment of the present invention.

FIG. 14 is a perspective view of a fourth variation of the ink cartridge 1. According to the fourth variation, the cutouts 49A and 49B are formed in the first and second housing parts 11 and 12, respectively, beside the ink supply opening part 25 of the ink bag 2 and/or the cap member 27 provided to the end of the ink supply opening part 25. Thus, depending on the positions of the cutouts 49A and 49B, it is possible to omit forming the cutout 79 in the third housing part 13.

Figure 15:
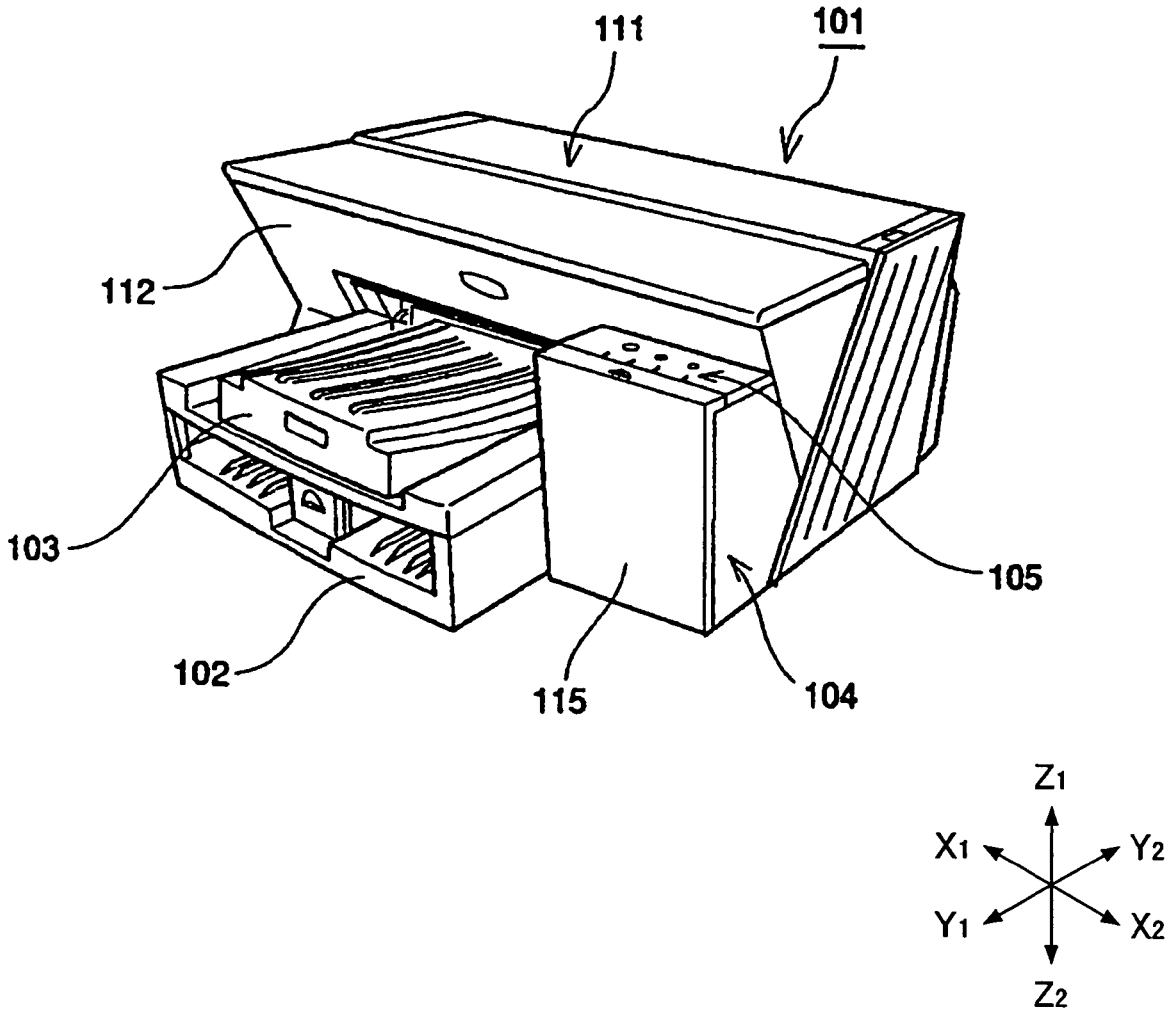
FIG. 15 is a perspective front view of an ink-jet recording apparatus that is an image-forming apparatus according to the first embodiment of the present invention.
Figure 16:
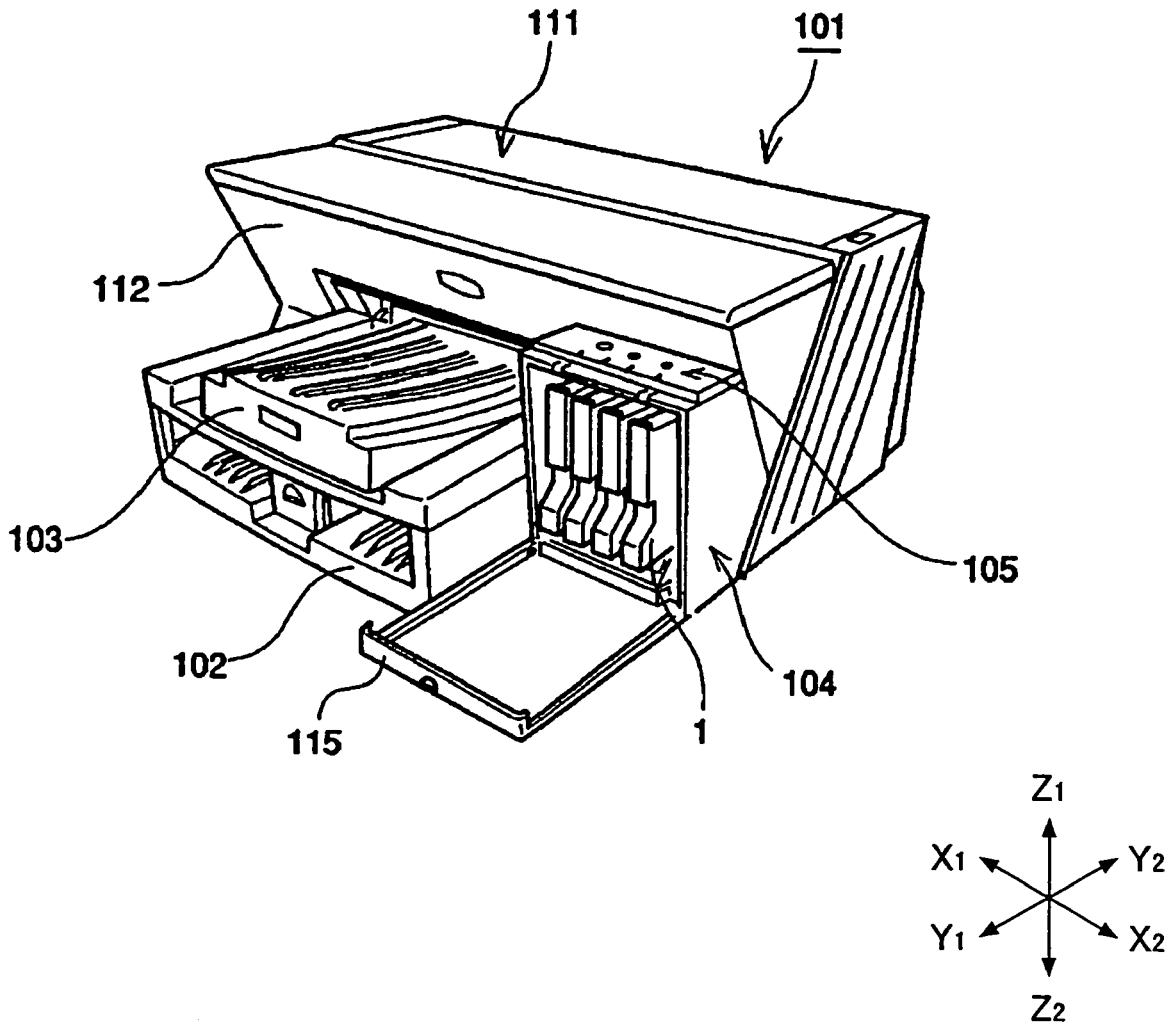
FIG. 16 is a perspective front view of the ink-jet recording apparatus in which a front cover of an ink cartridge loading part is opened according to the first embodiment of the present invention.
Figure 17:
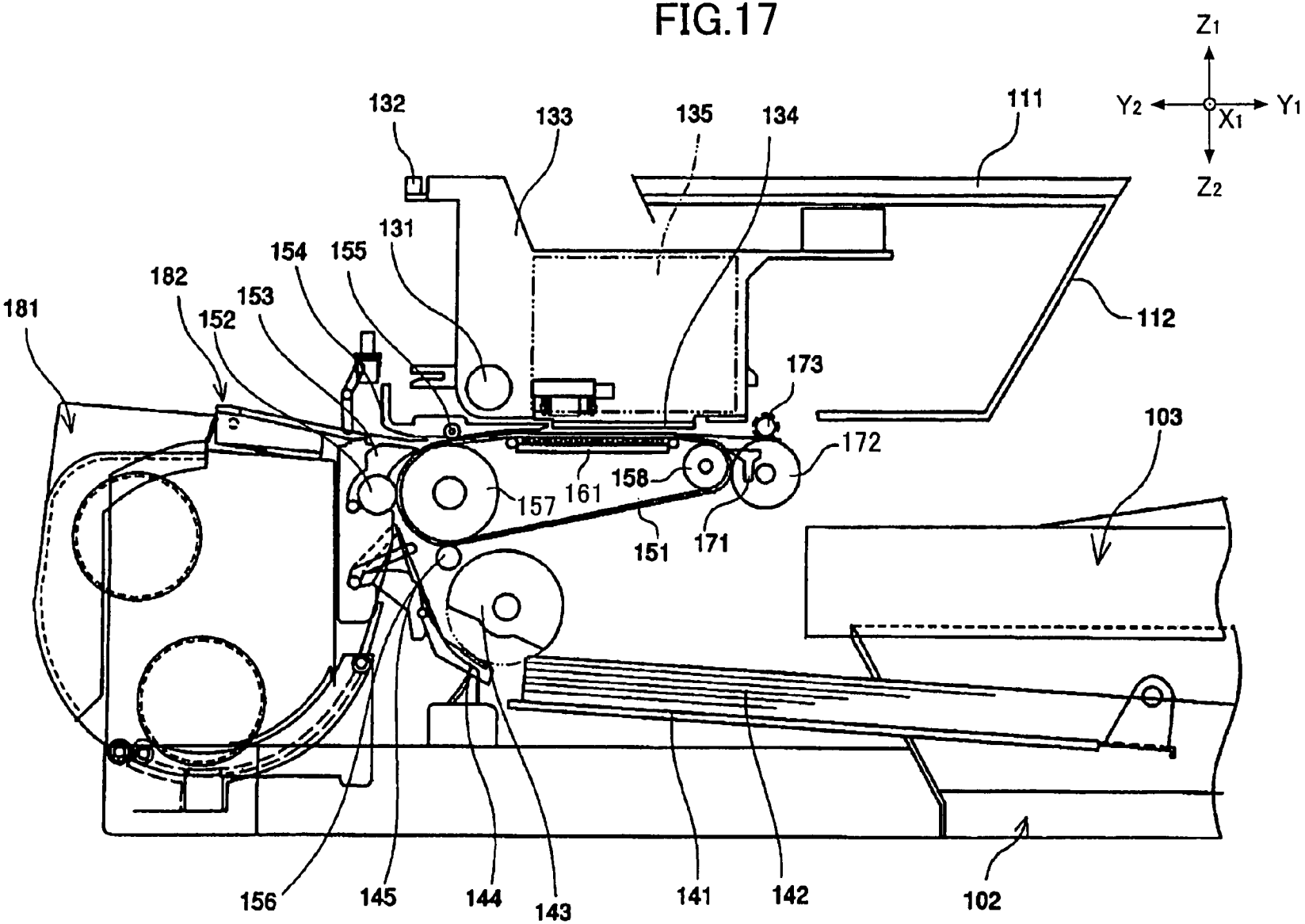
FIG. 17 is schematic diagram showing a configuration of a mechanism part of the ink-jet recording apparatus according to the first embodiment of the present invention.
Figure 18:
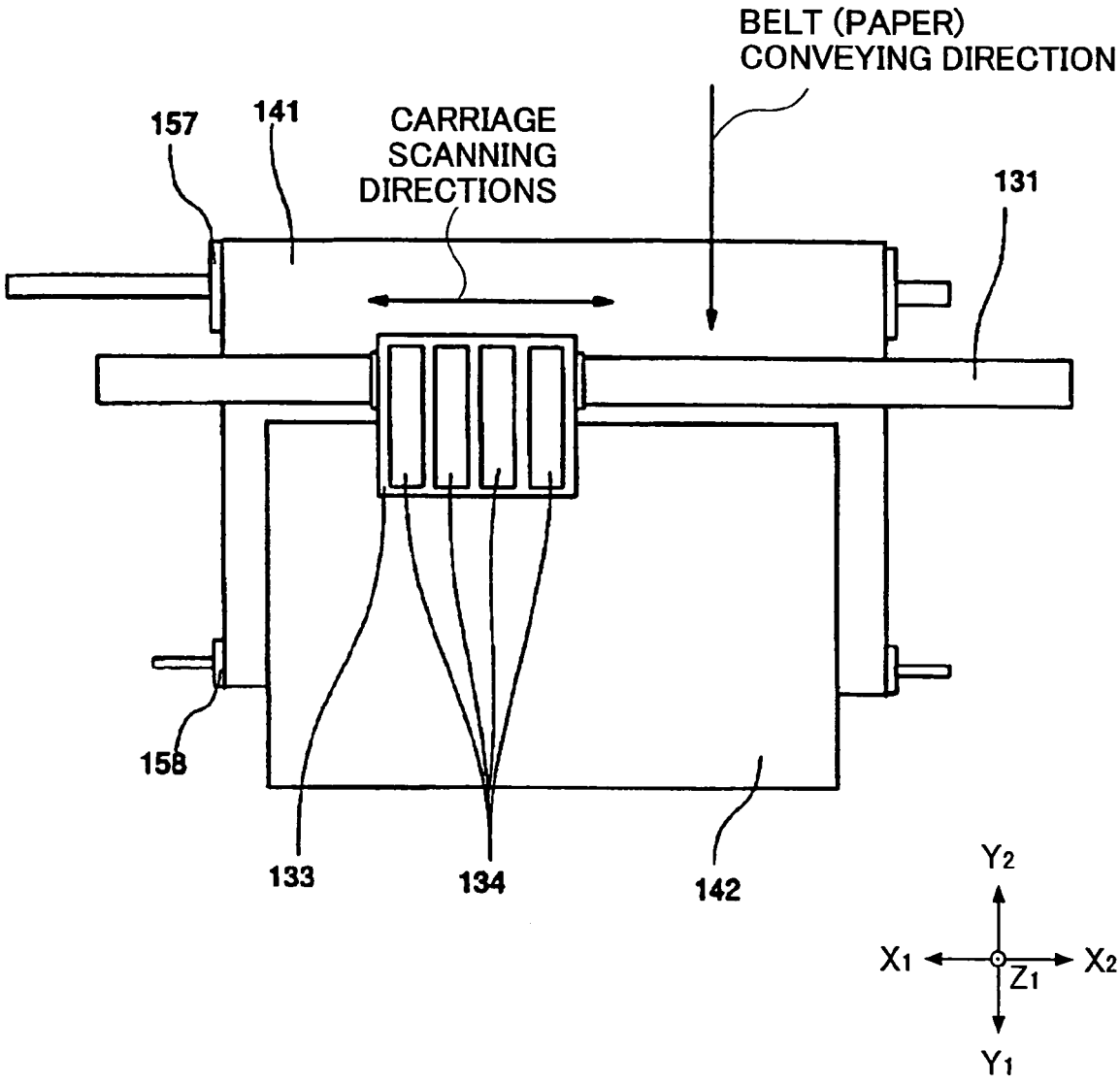
FIG. 18 is a plan view of part of the mechanism part of FIG. 17 according to the first embodiment of the present invention.

Next, a description is given, with reference to FIGS. 15 through 18, of an ink-jet recording apparatus that is an image-forming apparatus employing the ink cartridges 1 according to the first embodiment of the present invention. FIG. 15 is a perspective front view of the ink-jet recording apparatus. FIG. 16 is a perspective front view of the ink-jet recording apparatus in which a front cover 115 of an ink cartridge loading part 104 is opened. FIG. 17 is schematic diagram showing a configuration of the mechanism part of the ink-jet recording apparatus. FIG. 18 is a plan view of part of the mechanism part of FIG. 17.

The ink-jet recording apparatus includes an apparatus main body 101, a paper feed tray 102 for loading paper, and a paper ejection tray 103 for stocking paper on which an image is recorded (formed). The paper feed tray 102 and the paper ejection tray 103 are attached to the apparatus main body 101. The upper ($Z_1$) surface of an upper cover 111 of the apparatus main body 101 is substantially flat. A front ($Y_1$-side) surface 112 of the front cover of the apparatus main body 101 is provided at an angle with respect to the upper surface of the upper cover 111 so as to extend in a direction between the $Z_2$ and $Y_2$ directions. The paper feed tray 102 and the paper ejection tray 103 are provided below the front surface 112 so as to protrude toward the front ($Y_1$) side (or in the $Y_1$ direction).

Further, the ink cartridge loading part 104, which is an ink container loading part, is provided on the $X_2$ end of the front surface 112 at a position lower than the upper cover 111 so as to protrude from the front surface 112 toward the front ($Y_1$) side. An operation part 105 including operation keys and a display is provided on the upper surface of the ink cartridge loading part 104. The ink cartridge loading part 104 includes the front cover 115, which can be opened (FIG. 16) and closed (FIG. 15) so as to allow the attachment and detachment of the ink cartridges 1, which are ink containers. As shown in FIG. 16, the ink cartridges 1 are loaded into the ink-jet recording apparatus from its front ($Y_1$) side, that is, the front loading configuration is employed in the ink-jet recording apparatus.

Referring to FIGS. 17 and 18, in the apparatus main body 101, a guide rod 131 and a stay 132 are provided as guide members extending between side plates (not shown in the drawings) on the $X_1$ and $X_2$ sides. The guide rod 131 and the stay 132 hold a carriage 133 so that the carriage 133 is slidable in a main scanning direction or the $X_1$ and $X_2$ directions. A main scanning motor (not shown in the drawings) drives the carriage 133 so that the carriage 133 moves and scans in the $X_1$ and $X_2$ directions.

The carriage 133 includes a recording head 134 composed of four ink-jet heads of yellow (Y), cyan (C), magenta (M), and black (Bk) ejecting ink droplets of respective colors. The recording head 134 is attached so that the ink ejection openings of the recording head 134 are arranged in a direction to cross the main scanning direction and ink is ejected from the ink ejection openings in the $Z_2$ (downward) direction.

Each ink-jet head composing the recording head 134 may employ a piezoelectric actuator such as a piezoelectric element, a thermal actuator, a shape memory alloy actuator, or an electrostatic actuator as a part for generating energy to eject ink. The thermal actuator utilizes the phase change of liquid caused by film boiling using an electrothermal transducer such as a heating element. The shape memory alloy actuator utilizes the phase change of metal caused by a change in temperature. The electrostatic actuator employs an electrostatic force.

Sub tanks 135 of the four colors for supplying the respective color inks to the recording head 134 are mounted on the carriage 133. The color inks are supplied from the respective ink cartridges 1 loaded into the ink cartridge loading part 104 through ink supply tubes (not shown in the drawings) to the corresponding sub tanks 135.

Further, a paper feed part for feeding sheets of paper 142 stacked on a paper stacking part (a pressure plate) 141 of the paper feed tray 103 is provided. The paper feed part includes a crescent-shaped roller (a paper feed roller) 143 that separates and feeds the sheets of paper 142 one by one from the paper stacking part 141 and a separation pad 144 formed of a material with a high coefficient of friction and provided to oppose the paper feed roller 143. The separation pad 144 is biased toward the paper feed roller 143.

Further, a conveying part for conveying each sheet of paper 142 fed from the paper feed part below (on the $Z_2$ side of) the recording head 134 is provided. The conveying part includes a conveyor belt 151, a counter roller (a pressure roller) 152, a conveying guide 153, an edge pressure roller 155, and a charging roller 156. The conveyor belt 151 conveys the sheet of paper 142 by causing the sheet of paper 142 to adhere electrostatically to the conveyor belt 151. A sheet of paper 142 is fed through a guide 145 from the paper feed part to be conveyed and held between the conveyor belt 151 and the counter roller 152. The conveying guide 153 changes the conveying direction of the sheet of paper 142 fed substantially vertically in the upward ($Z_1$) direction by substantially 90 degrees so that the sheet of paper 142 is conveyed on and along the conveyor belt 151. The edge pressure roller 155 is biased toward the conveyor belt 151 by a holding member 154. The charging roller 156 is a charging part that charges the surface of the conveyor belt 151.

The conveyor belt 151 is an endless belt (a belt with no ends or a belt whose ends are connected), and engages a conveying roller 157 and a tension roller 158 so as to extend therebetween. The conveyor belt 151 rotates in the belt conveying direction (as indicated in FIG. 18). The conveyor belt 151 includes a top (outer) layer and a bottom (inner) layer. The top layer serves as a paper adhesion surface to which a sheet of paper 142 may adhere. The top layer is formed of an approximately 40 μm-thick pure resin material, for instance, a pure ETFE (Ethylene Tetra Fluoro Ethylene) material, with no resistance control. The bottom layer is formed of the same material as the top layer, to which resistance control by carbon is provided. The bottom layer may also be referred to as a medium resistance layer or a ground layer.

On the bottom-layer (inner) side of the conveyor belt 151, a guide member 161 is provided at a position corresponding to a printing region where the recording head 134 performs printing.

Further, a paper ejection part for ejecting each sheet of paper 142 on which the recording head 134 has performed recording is provided. The paper ejection part includes a separation claw 171 serving as a separation mechanism for separating the sheet of paper 142 from the conveyor belt 151, and paper ejection rollers 172 and 173. The paper ejection tray 103 is provided below the paper ejection roller 172. The separation claw 41 is provided in contact with the conveyor belt 21.

A duplex paper feed unit (a duplex printing mechanism) 181 for duplex printing (printing on both sides of the sheet of paper 142) is attached to the rear ($Y_2$) side of the apparatus main body 101 so as to be detachable therefrom and attachable thereto. The duplex paper feed unit 181 receives (captures) the sheet of paper 142 conveyed in the direction opposite to the belt conveying direction by the reverse rotation of the conveying belt 151. Then, the duplex paper feed unit 181 turns the received sheet of paper 142 upside down, and again feeds the turned sheet of paper 142 to the space between the counter roller 152 and the conveyor belt 151. A manual paper feed part 182 is provided on the upper surface of the duplex paper feed unit 181.

According to the ink-jet recording apparatus having the above-described configuration, sheets of paper 142 are separated and fed one by one from the paper feed part, and each sheet of paper 142 is fed substantially vertically in the upward direction and is guided by the guide 145 to be conveyed and held between the conveyor belt 151 and the counter roller 152. Then, the fed sheet of paper 142 has its leading edge guided by the conveying guide 153 and pressed against the conveyor belt 151 by the edge pressure roller 155. Thereby, the conveying direction of the sheet of paper 142 is changed by approximately 90 degrees.

At this point, the conveyor belt 151 is charged by the charging roller 156 so that the sheet of paper 142 is conveyed on the conveyor belt 151, adhering electrostatically thereto. Then, by driving the recording head 134 in accordance with an image signal while moving the carriage 133, ink droplets are ejected on the sheet of paper 142 in a stationary state so as to perform recording for a line. After conveying the sheet of paper 142 a predetermined distance, recording is performed for the next line. When a recording end signal or a signal indicating that the trailing edge of the sheet of paper 142 has reached the recording region is received, the recording operation ends and the sheet of paper 142 is ejected onto the paper ejection tray 103.

When the amount of remaining ink is near zero in any of the sub tanks 135 and such a state is detected, a required amount of ink is supplied from the corresponding ink cartridge 1 to the sub tank 135.

The ink-jet recording apparatus includes the ink cartridges 1 according to the present invention. Therefore, when the ink of any of the ink cartridges 1 is used up, it is possible to disassemble the housing 3 of that ink cartridge 1 and replace only the internal ink bag 2 with a new one. Further, it is possible to supply ink stably even when the ink cartridge 1 in placed in the upright position in the front loading configuration. Accordingly, even when the ink-jet recording apparatus is housed in a rack or an object is placed on the upper surface of the apparatus main body 101 so that the space above the apparatus main body 101 is limited or occupied, the ink cartridge 1 can be replaced easily.

Figure 19:
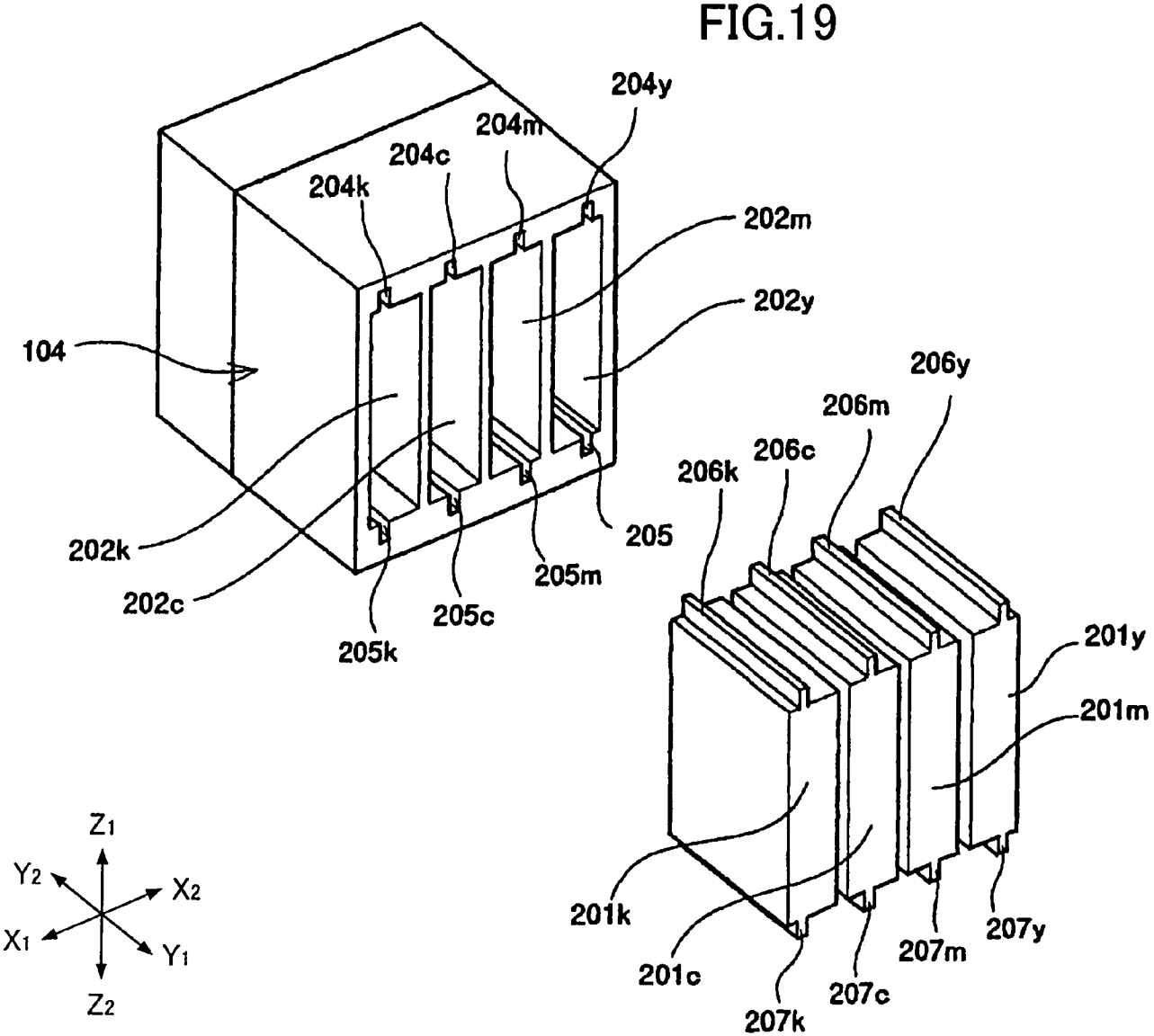
FIG. 19 is a diagram for illustrating the relationship between the ink cartridge loading part of the ink-jet recording apparatus and ink cartridges according to a second embodiment of the present invention.
Figure 20:
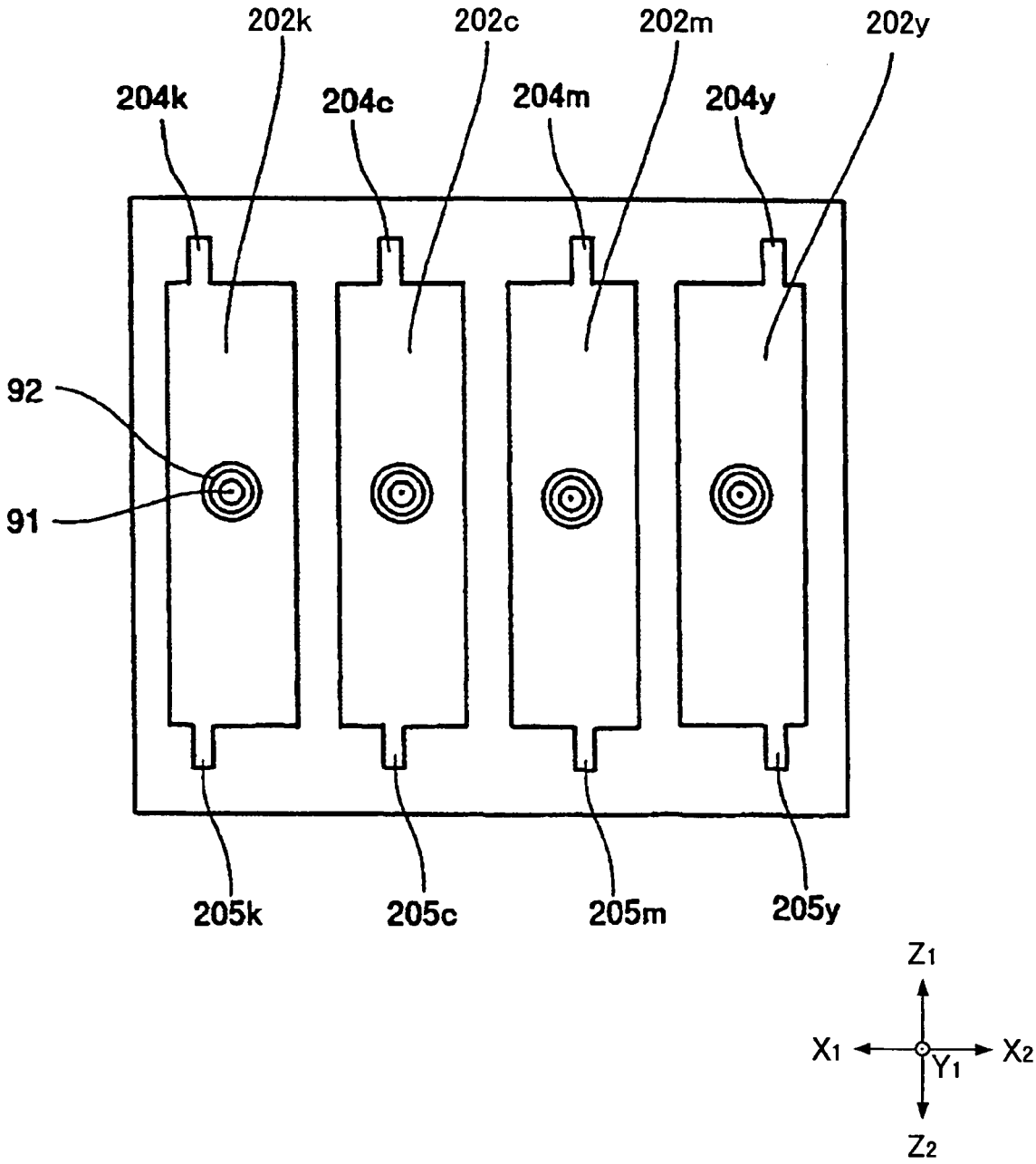
FIG. 20 is a front view of the ink cartridge loading part according to the second embodiment of the present invention.

Next, a description is given, with reference to FIGS. 19 and 20, of an ink-jet recording apparatus, which is an image-forming apparatus, according to a second embodiment of the present invention. According to the second embodiment, ink cartridges, which are ink containers, containing ink of the same color but having different shapes are attachable to the ink cartridge loading part 104, which is an ink container loading part, of the ink-jet recording apparatus. FIG. 19 is a diagram for illustrating the relationship between the ink cartridge loading part 104 of the ink-jet recording apparatus and ink cartridges 201*y*, 201*m*, 201*c*, and 201*k* (also referred to as ink cartridges 201 or collectively as an ink cartridge 201 when no distinction therebetween is necessary) according to the second embodiment. FIG. 20 is a front view of the ink cartridge loading part 104. In this embodiment, the same elements as those of the first embodiment are referred to by the same numerals, and a description thereof is omitted.

The ink cartridge loading part 104 of the apparatus main body 101 includes cartridge insertion holes 202*y*, 202*m*, 202*c*, and 202*k* (also referred to as cartridge insertion holes 202 or collectively as a cartridge insertion hole 202 when no distinction therebetween is necessary) for receiving the ink cartridges 201*y*, 201*m*, 201*c*, and 201*k*, respectively.

Referring to FIG. 20, the hollow needle 91, which is an ink introduction part on the apparatus main body side, and the needle guard 92 as shown in FIG. 12 are provided at the bottom part of each cartridge insertion hole 202 of the ink cartridge loading part 104.

Further, guide grooves 204*y*, 204*m*, 204*c*, and 204*k* (also referred to as guide grooves 204 or collectively as a guide groove 204 when no distinction therebetween is necessary) are formed on the upper internal surfaces and guide grooves 205*y*, 205*m*, 205*c*, and 205*k* (also referred to as guide grooves 205 or collectively as a guide groove 205 when no distinction therebetween is necessary) are formed on the lower internal surfaces of the cartridge insertion holes 202*y*, 202*m*, 202*c*, and 202*k*, respectively, at different positions corresponding to the ink colors of the ink cartridges 201*y*, 201*m*, 201*c*, and 201*k* loadable into the cartridge insertion holes 202*y*, 202*m*, 202*c*, and 202*k*, respectively.

On the other hand, ribs 206*y*, 206*m*, 206*c*, and 206*k* (also referred to as ribs 206 or collectively as a rib 206 when no distinction therebetween is necessary) and ribs 207*y*, 207*m*, 207*c*, and 207*k* (also referred to as ribs 207 or collectively as a rib 207 when no distinction therebetween is necessary) are provided to the ink cartridges 201*y*, 201*m*, 201*c*, and 201*k*, respectively, at predetermined positions so that the ribs 206*y*, 206*m*, 206*c*, and 206*k* are fittable into (engageable with) the guide grooves 204*y*, 204*m*, 204*c*, and 204*k*, respectively, and the ribs 207*y*, 207*m*, 207*c*, and 207*k* are fittable into (engageable with) the guide grooves 205*y*, 205*m*, 205*c*, and 205*k*, respectively. The position of the rib 206 relative to the ink supply opening part 25 differs among the ink cartridges 201 depending on the color of the ink contained therein. The position of the rib 207 relative to the ink supply opening part 25 also differs among the ink cartridges 201 depending on the color of the ink contained therein.

Between a plurality of versions (types) of each ink cartridge 201, which versions contains the same color ink but have different shapes, the relationship between the positions of the ribs 206 and 207 and the position of the corresponding hollow needle 91 of the ink cartridge loading part 104 is defined, and the ribs 206 and 207 are formed under this defined positional relationship.

Figure 21:
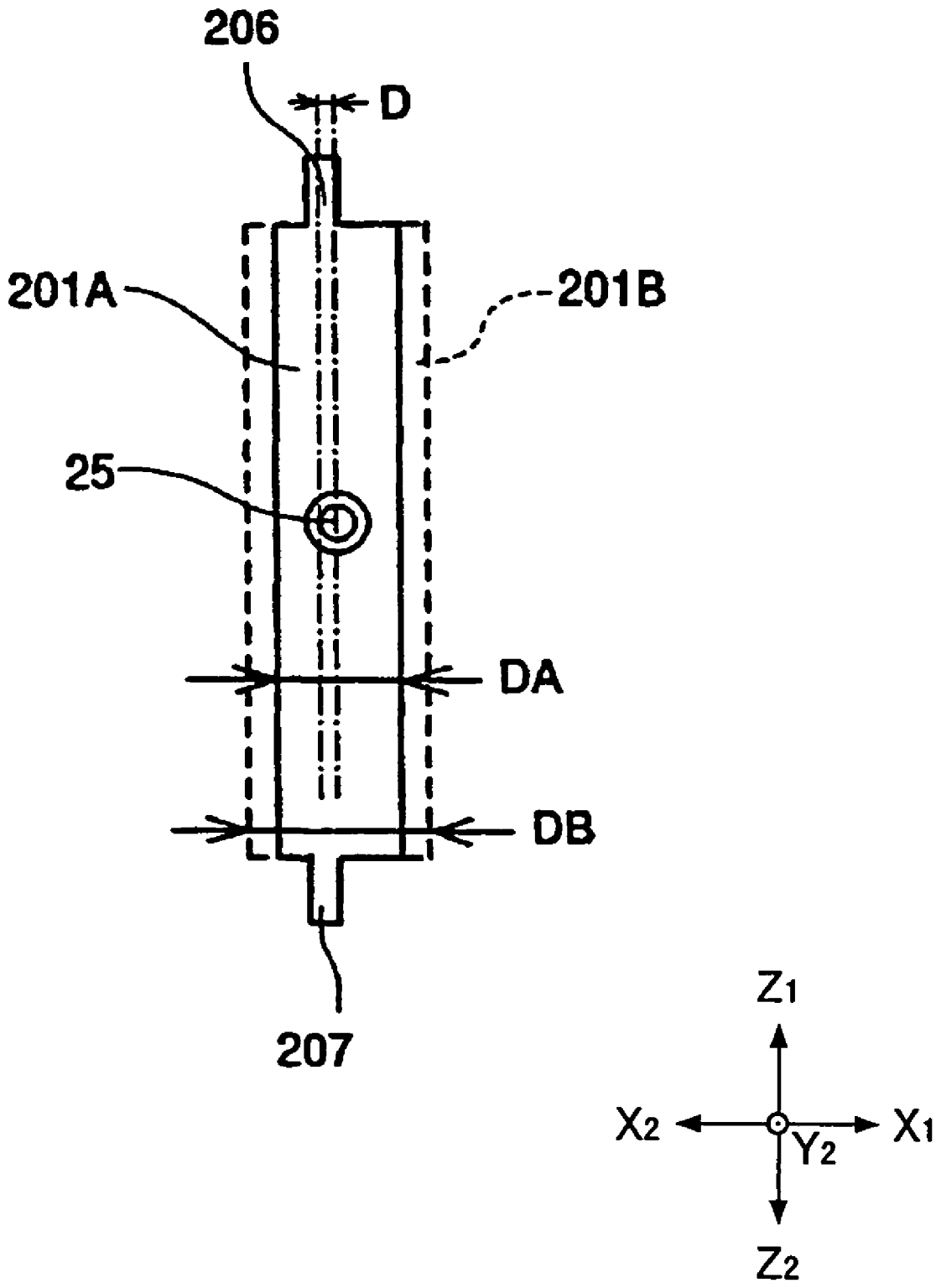
FIG. 21 is a diagram for illustrating ink cartridges of different shapes according to the second embodiment of the present invention.

A description is given, with reference to FIG. 21, of this respect. Here, the ink cartridge 201 may be realized by two versions: an ink cartridge 201A that contains an ink bag 2 of a relatively small capacity, and has a relatively small thickness DA in shape; and an ink cartridge 201B that contains an ink bag 2 of a relatively large capacity and has a relatively large thickness DB (>DA) in shape. The ink cartridges 201A and 201B are indicated by the solid and broken lines, respectively, in FIG. 21. The thicknesses DA and DB of the ink cartridges 201A and 201B are measured in the directions in which the first and second housing parts 11 and 12 are separable, or in the direction of thickness of the flexible films 30 forming the ink bag 2.

Referring to FIG. 21, the ribs 206 and 207, which engages the guide grooves 204 and 205, respectively, of the cartridge insertion hole 202, of the ink cartridge 201A and those of the ink cartridge 202B are formed at the same positions relative to the ink supply opening part 25. In the case of FIG. 21, the ribs 206 of the ink cartridges 201A and 201B are formed at the same position offset from the ink supply opening part 25 by a distance D. Likewise, the ribs 207 of the ink cartridges 201A and 201B are formed at the same position offset from the ink supply opening part 25 by the distance D. The ink cartridges 201A and 201B have the same height (dimension along the Y-axis), and the ink supply opening parts 25 thereof also have the same height.

At this point, the ribs 206 and 207 of the ink cartridge 201 indicate the color of ink to be contained therein. Further, since the positional relationship between the ribs 206 and 207 and the ink supply opening part 25 is defined as described above, the ribs 206 and 207 serve as a positioning part that defines the relationship between the position of the ink cartridge 201 and the position of the hollow needle 91 provided at the bottom of the cartridge insertion hole 202.

Figure 22:
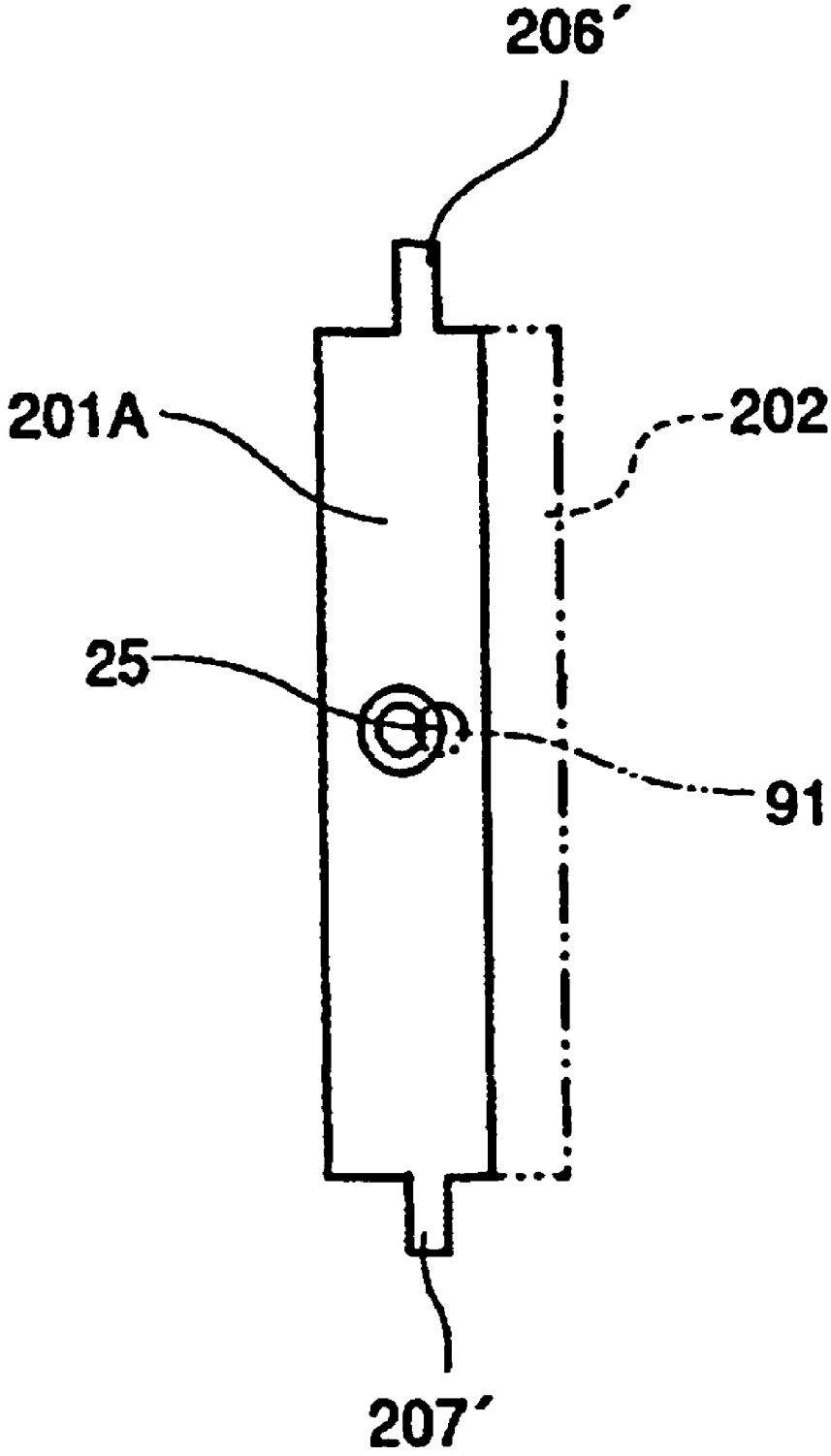
FIG. 22 is a diagram for illustrating a positional relationship between ink cartridges of different shapes and a cartridge insertion hole according to the second embodiment of the present invention.

That is, in the case of employing the thin ink cartridge 201A of a small capacity and the thick ink cartridge 201B of a large capacity, when the relationship between the positions of the cartridge insertion hole 202 and its guide grooves 204 and 205 and the positions of the ribs 206 and 207 of the large-capacity ink cartridge 201B is defined as shown in FIG. 22, the small-capacity ink cartridge 201A may be fitted into the cartridge insertion hole 202 even if the ink cartridge 201A has ribs 206' and 207' whose positional relationship to the hollow needle 91 (indicated by the ink supply opening part 25 herein) is defined as shown in FIG. 22.

However, if the ribs 206' and 207' are formed with the positional relationship as shown in FIG. 22, the small-capacity ink cartridge 201A may be fitted into the cartridge insertion hole 202, but the positions of the ink supply opening part 25 and the hollow needle 91 are prevented from being aligned. As a result, the ink cartridge 201A cannot be attached to the ink cartridge loading part 104.

Further, not only the small-capacity ink cartridge 201A with the ribs 206' and 207' may be inserted into the cartridge insertion hole 202 for the ink cartridge 201 of another color, but also the ink supply opening part 25 of the ink cartridge 201A may be aligned with the hollow needle 91 of the cartridge insertion hole 202 into which the ink cartridge 201A has been wrongly inserted. This results in a mixture of ink colors, thus preventing a desired image from being obtained.

Further, if the positional relationship between the ribs 206 and 207 and the ink supply opening part 25 differs between the ink cartridges 201 that are different in size and ink capacity, this undesirably makes it difficult and troublesome for users to align the ribs 206 and 207 with the guide grooves 204 and 205 at the time of replacing the ink cartridge 201.

Therefore, the relative positional relationship between the ribs 206 and 207 for positioning and the ink supply opening part 25 remains the same between the ink cartridges 201A and 201B containing the same color ink but having different shapes so that the ink cartridges 201A and 201B can be loaded into the same cartridge insertion hole 202 of the ink cartridge loading part 104. That is, the ink cartridge 201 has the same positional relationship between the ribs 206 and 207 to serve as a positioning part and the ink supplying opening part 25 for supplying ink to the apparatus main body side as another ink container (ink cartridge) that contains the same color ink but has a different shape, and is loadable into the same image-forming apparatus.

In each individual ink cartridge 201, the ribs 206 and 207 serve as a positioning part that defines the positional relationship between the ink cartridge 201 and the ink introduction part (hollow needle 91) of the ink cartridge loading part 104.

Thus, according to the second embodiment, by forming ribs so that the relationship between the ribs and an ink supply opening part, that is, the ink introduction part of an ink cartridge loading part, remains the same between ink cartridges for containing the same color ink, a required one of the ink cartridges can be attached to the ink cartridge loading part with ease even if the ink cartridges are different in shape. This improves the operability of ink cartridges and widens the range of choices of ink cartridges.

That is, in the above-described case, with respect to the ink cartridge 201 for containing a predetermined color ink, each of the small-capacity version (ink cartridge) 201A and the large-capacity version (ink cartridge) 201B is attachable to the corresponding cartridge insertion hole 202 irrespective of its ink capacity.

In this embodiment, the ribs 206 and 207 are formed on the ink cartridge 201, and the guide grooves 204 and 205 engaging the ribs 206 and 207, respectively, are formed in the ink cartridge loading part 104 on the apparatus main body side. However, the ribs 206 and 207 may be formed on the ink cartridge loading part 104, and the guide grooves 204 and 205 may be formed in the ink cartridge 201 so that the ribs 206 and 207 engage the guide grooves 204 and 205, respectively.

Figure 23:
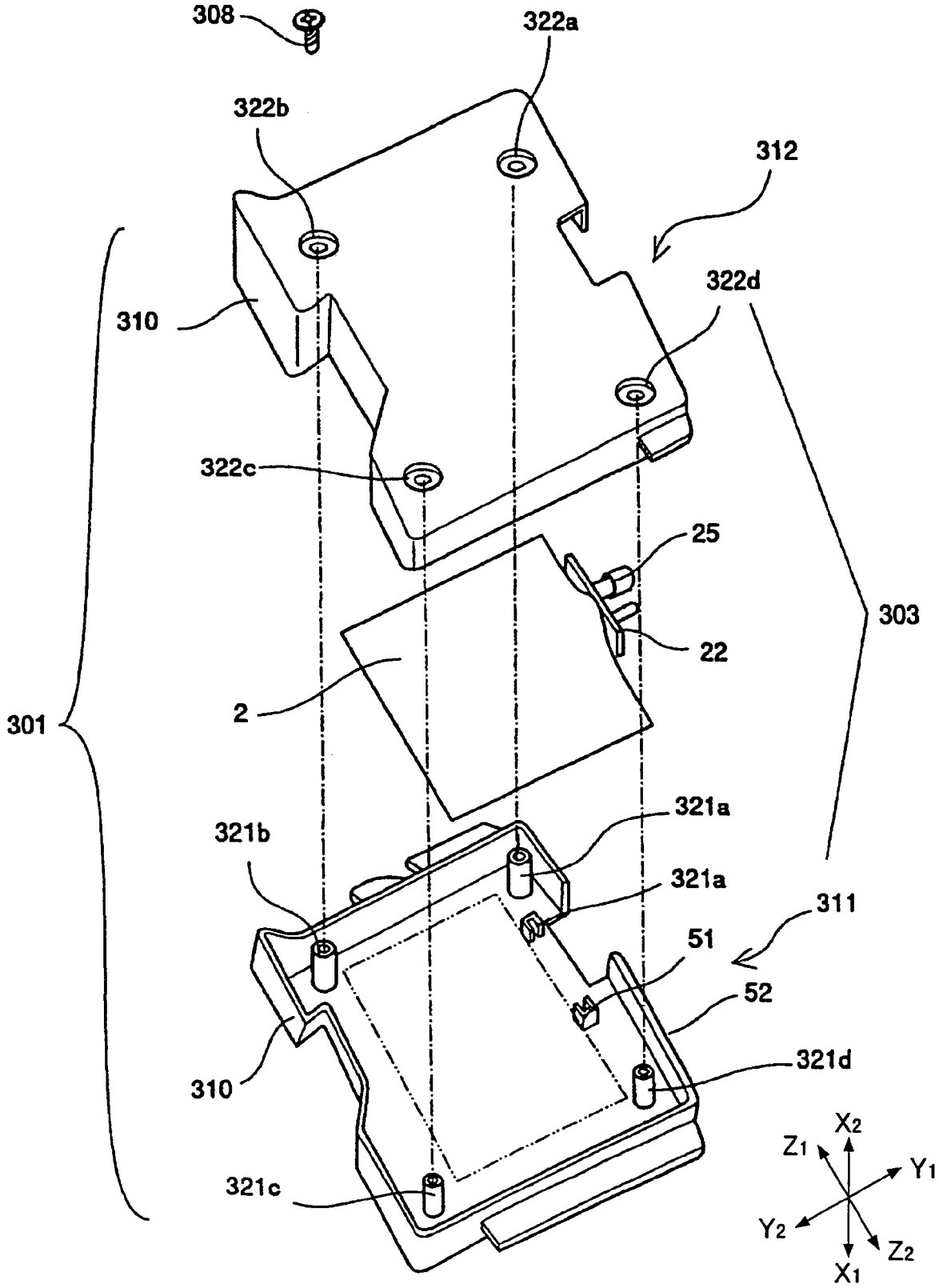
FIG. 23 is an exploded perspective view of an ink cartridge according to a third embodiment of the present invention.
Figure 24:
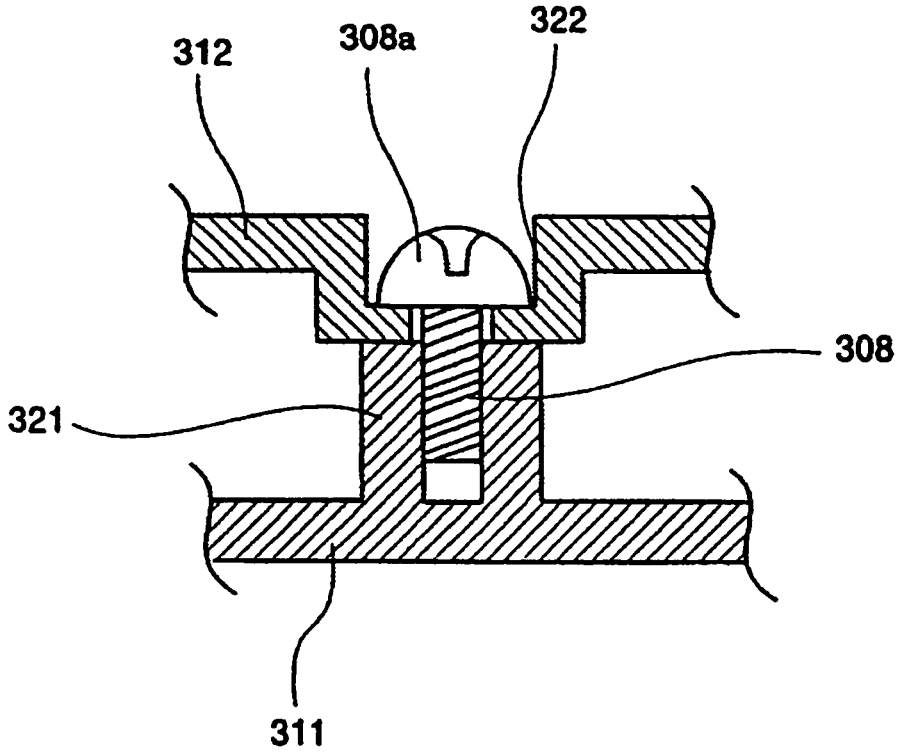
FIG. 24 is a sectional view of part of the ink cartridge according to the third embodiment of the present invention.
Figure 25:
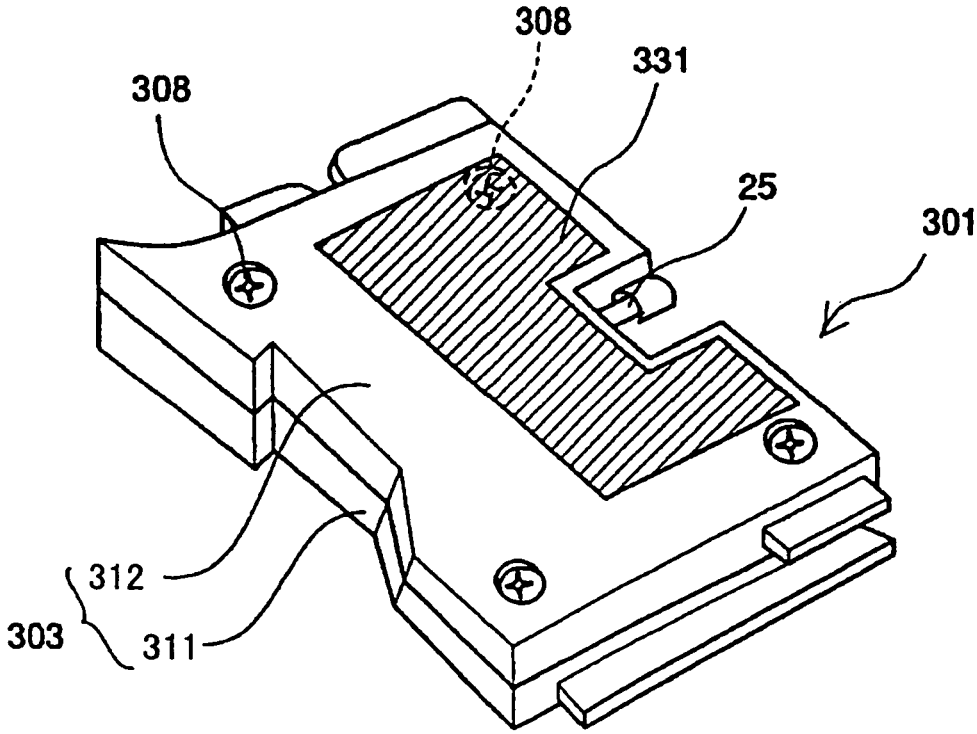
FIG. 25 is a perspective view of the ink cartridge in an assembled state according to the third embodiment of the present invention.

Next, a description is given, with reference to FIGS. 23 through 25, of a housing fixing structure of an ink cartridge whose housing is dividable as described above according to a third embodiment of the present invention. FIG. 23 is an exploded perspective view of an ink cartridge 301 according to the third embodiment of the present invention. FIG. 24 is a sectional view of part of the ink cartridge 301. FIG. 25 is a perspective view of the ink cartridge 301 in an assembled state. In this embodiment, the same elements as those of the above-described embodiments are referred to by the same numerals, and a description thereof is omitted.

Referring to FIG. 23, the ink cartridge 301, which is an ink container, includes the ink bag 2, which is an ink containing part, and a housing 303 for housing the ink bag 2. The housing 303 is formed of a first housing part 311 and a second housing part 312 that are separable from each other. As the above-described ink cartridge 1 according to the first embodiment, the housing 303 may be formed of three separable parts (first, second, and third housing parts).

In this embodiment, the first and second housing parts 311 and 312 are separable in the direction of thickness of the flexible films 30 forming the ink bag 2 housed in the housing 303 (or along the X-axis in FIG. 23). According to this configuration, the ink bag 2 can be set previously in one of the first and second housing parts 311 and 312 (for instance, in the first housing part 311). Accordingly, the condition of the ink bag 2 set in the first housing part 311, for instance, (as shown in FIG. 8 of the first embodiment) can be checked easily.

On the other hand, even in the case of employing an ink bag using flexible films, if the ink bag is integrated with a housing, or the housing is dividable in a direction perpendicular to the direction of thickness of the flexible films, it is difficult to do a last-minute check of the set ink bag if the ink bag is set in a longitudinal direction. Therefore, even if the set ink bag deforms into a shape different from what is intended, it is difficult to find it out.

However, the first and second housing parts 311 and 312, which are separable as described above, are structured so that the peripheral edges of the first and second housing parts 311 and 312 come into contact with each other around the ink bag 2 when the first and second housing parts 311 and 312 are joined. That is, the length of the joined part of the first and second housing parts 311 and 312 is relatively long so that the assembly of the first and second housing parts 311 and 312 or the housing 303 is likely to be reduced in rigidity.

If the peripheral edges of the first and second housing parts 311 and 312 are put together and welded throughout in order to eliminate this disadvantage of reduced rigidity, however, the housing 303 is prevented from being reused. Further, this also requires special facilities as well as a large amount of time, thus resulting in reduced mass-productivity.

Accordingly, like the above-described ink cartridge 1 of FIG. 10 of the first embodiment, the first and second housing parts 311 and 312 are fastened together at four points using screw members 308 as fastening members. As a result, it is ensured that the first and second housing parts 311 and 312 are fixed together to increase rigidity. Further, it is possible to disassemble the first and second housing parts 311 and 312.

Referring to FIGS. 23 and 24, boss parts 321*a* through 321*d* into which the screw members 308 are screwed are formed at four points in the same direction on the first housing part 311. Recesses 322*a* through 322*d* into which heads 308*a* of the screw members 308 are fitted are formed in the second housing part 312 at points corresponding to the boss parts 321*a* through 321*d* of the first housing part 311. A through hole for the screw member 308 is formed at the bottom of each of the recesses 322*a* through 322*d*.

As an ink cartridge becomes larger in capacity, the housing of the ink cartridge and an ink bag (ink containing part) housed therein also become larger in size. Therefore, in the case of screwing up a dividable housing, it is necessary to screw up the housing at a plurality of points. In this case, if the direction of screwing differs among the points, there is a screw left untightened, or the operation of screwing becomes longer in time.

Therefore, in the ink cartridge 301, the boss parts 321*a* through 321*d* are formed on the first housing part 311 (in the case of FIG. 23) so that the screw members 308 are tightened in the same direction. As a result, a plurality of screwing operations can be performed in a single direction. This increases the operability of screwing, and also makes it easy to check whether there is any screw left untightened.

Further, in the case of fixing the separate housing parts 311 and 312 together using the screw members 308, if the heads 308*a* of the screw members 308 project from the housing part 311 or 312, the space for housing the ink cartridge 301 is increased in volume. Particularly, the ink cartridges 301 are commonly arranged side by side as in the above-described image-forming apparatus. Therefore, an increase in the volume of the space for containing the ink cartridge 301 (or an increase in the area of the opening of the cartridge insertion hole 202 of the ink cartridge loading part 104) causes an increase in the size of the entire image-forming apparatus.

Therefore, according to the ink cartridge 301, the recesses 322*a* through 322*d* into which the heads 308*a* of the screws 308 are fitted are formed in the second housing part 312. This prevents the heads 308*a* of the screw members 308 from projecting from the surface of the second housing part 312. Accordingly, there is no need to unnecessarily enlarge the volume of the space for containing the ink cartridge 301 (or an increase in the area of the opening of the cartridge insertion hole 202) in the ink cartridge loading part 104). Thus, the ink cartridge 301 and the image-forming apparatus containing can be reduced in size.

Further, if the boss parts 321*a* through 321*d* for screw tightening are provided at positions interfering with the ink bag 2, the normal shape of the ink bag 2 is lost. Therefore, when a large amount of ink is left in the ink bag 2, a failure in ink ejection or undesired ink dripping due to an increase in the internal pressure may be caused. On the other hand, while the amount of remaining ink decreases, the ink bag 2 is prevented from losing shape appropriately, thus forcing a large amount of ink to be left unused in the ink bag 2.

Therefore, according to the ink cartridge 301, in order to prevent the above-described problem from occurring, the boss parts 321*a* through 321*d* for screw tightening are provided at positions that do not interfere with the space for housing the ink bag 2.

Further, in order to reduce the image-forming apparatus in size, the internal components of the ink cartridge are integrated to a higher degree. Therefore, the ink cartridge can have a handle part provided at only a limited position as a part used in attaching the ink cartridge to or detaching the ink cartridge from the apparatus main body. Particularly, in the ink cartridge that is dividable in the direction of thickness of the flexible films according to the present invention, the handle part is likely to be provided in the neighborhood of a fitting part of the ink cartridge in which part the separable parts of the housing of the ink cartridge are fitted to each other. In this case, a force is factitiously applied when the ink cartridge is attached or detached. Accordingly, it is anticipated that a force more than expected is exerted. Therefore, misalignment due to deformation occurs in the neighborhood of the fitting part, which is not preferable in terms of operation.

Accordingly, in the ink cartridge 301, the boss part 321*b* is provided inside a handle part 310 (equal to the projecting part 42 of FIG. 2) so that the first and second housing parts 311 and 312 are fastened together near the handle part 301, thereby increasing the strength of the ink cartridge 301.

As described above, compared with a fastening method such as welding, the fastening structure using a screw requires no special facilities, ensures secure fastening, and has excellent reusability (recyclability). On the other hand, its fastening method can be expected by anyone, so that the ink cartridge is likely to be disassembled easily. Particularly, the disassembling of the ink cartridge by a user out of mere curiosity may damage the ink bag unintentionally. If this causes ink leakage, there is a great fear for the contamination of its environment. Further, there is another problem in that the design of the ink cartridge may be spoiled greatly by the screws visible from outside.

Accordingly, as shown in FIG. 25, in the ink cartridge 301, a decal 331 is applied on the outer surface of the second housing part 312 so as to conceal at least one of the screw members 308. The decal 331 is replaceable by a label. Instead of or together with the decal 331 or a label, a member such as a cap may be employed to conceal the head 308*a* of the screw member 308.

In the above-described embodiments, the ink-jet recording apparatus is a serial-type (shuttle-type) ink-jet recording apparatus where a carriage performs scanning. The present invention, however, is also applicable to a line-type ink-jet recording apparatus having a line-type head.

In addition to an ink-jet printer, the ink-jet recording apparatus according to the present invention is also applicable to a facsimile machine, a copier, and a multi-function apparatus including the functions of a printer, a facsimile machine, and a copier.

The present invention is not limited to the specifically disclosed embodiments, and variations and modifications may be made without departing from the scope of the present invention.

The present application is based on Japanese priority applications No. 2002-354958, filed on Dec. 6, 2002, and No. 2003-387507 filed on Nov. 18, 2003, the entire contents of which are hereby incorporated by reference.

The invention claimed is:

1. An ink cartridge, comprising:

an ink containing part including a holding member with an ink supply opening part and a sealed ink filling opening part;

a first housing including a holding part holding the holding member of said ink containing part;

a second housing whose outline is analogous to an outline of said first housing; and a third housing fitted to a side of an assembly of said first and second housings from which side ink is supplied, wherein said first, second, and third housings are assemblable and disassemblable.

2. The ink cartridge as claimed in claim 1, wherein said ink containing part is an ink bag including a bag-like part.

3. The ink cartridge as claimed in claim 2, wherein the ink bag is formed of a member including an aluminum laminate film.

4. The ink cartridge as claimed in claim 1, further comprising an engagement mechanism that engages said first and second housings.

5. The ink cartridge as claimed in claim 4, wherein said engagement mechanism comprises an engagement claw provided to one of said first and second housings and an engagement part provided to the other one of said first and second housings, the engagement claw and the engagement part engaging each other.

6. The ink cartridge as claimed in claim 1, further comprising a label applied to each of said first and second housings so as to reinforce engagement of said third housing with said first and second housings.

7. The ink cartridge as claimed in claim 1, further comprising a screw member that fixes said first and second housings together.

8. The ink cartridge as claimed in claim 1, wherein at least one of said first, second, and third housings comprises a cutout beside the ink supply opening part and/or a cap member provided to an end of the ink supply opening part of said ink containing part.

9. An ink-jet recording apparatus into which an ink cartridge containing an ink containing part is loadable from a front side thereof, wherein:

the ink cartridge is an ink cartridge as set forth in claim 1.

10. The ink cartridge as claimed in claim 1, further comprising:

a positioning part configured to define a positional relationship between the ink cartridge and an ink introduction part provided to an ink container loading part of an image-forming apparatus, wherein the ink cartridge is replaceably attachable to the ink container loading part of the image-forming apparatus.

11. The ink cartridge as claimed in claim 10, wherein said positioning part is a rib engageable with a groove provided to the ink container loading part.

12. The ink cartridge as claimed in claim 10, wherein said positioning part is a groove engageable with a rib provided to the ink cartridge loading part.

13. The ink cartridge as claimed in claim 10, wherein said positioning part is provided at a position corresponding to a color of ink contained in the ink cartridge.

14. The ink cartridge as claimed in claim 10, wherein a positional relationship between said positioning part and an ink supply opening part for supplying ink to the image-forming apparatus is equal to that of another ink cartridge, the other ink cartridge containing ink of a color equal to that of ink contained in the cartridge, and having a shape different from that of the ink cartridge.

15. The ink cartridge as claimed in claim 10, wherein a positional relationship between said positioning part and an ink supply opening part for supplying ink to the image-forming apparatus remains constant irrespective of a shape of the ink cartridge.

16. An image-forming apparatus, comprising:

an ink container loading part to which the ink cartridge as set forth in claim 1 is replaceably attachable, wherein said ink container loading part comprises a positioning part for loading ink cartridges that contain ink of a single color and have different shapes.

17. The image-forming apparatus as claimed in claim 16, wherein the ink cartridge comprises a positioning part configured to define a positional relationship between the ink cartridge and an ink introduction part provided to the ink container loading part.

18. The ink cartridge as claimed in claim 1, wherein at least one screw member is employable as a fastening member to keep the first and second housings in an assembled state.

19. The ink cartridge as claimed in claim 18, wherein a plurality of screw members are employable as fastening members to keep said dividable housing in the assembled state; and the screw members are tightened in a single direction.

20. The ink cartridge as claimed in claim 19, wherein at least one of the screw members is concealed from outside view.

21. The ink cartridge as claimed in claim 18, wherein said dividable housing is dividable into a plurality of parts; and a boss part into which the screw member is screwed is formed on one of the parts of said dividable housing, and a recess into which a head of the screw member is fitted is formed in another one of the parts of said dividable housing.

22. The ink cartridge as claimed in claim 21, wherein said boss part is provided at a position prevented from interfering with the ink bag.

23. The ink cartridge as claimed in claim 18, wherein the fastening member is provided near a handle part provided to said dividable housing.

24. The ink cartridge as claimed in claim 18, wherein the screw member is concealed from outside view.

25. An image-forming apparatus, comprising:

an ink container loading part to which the ink cartridge as set forth in claim 18 is replaceably attachable.

26. An ink cartridge comprising:

an ink containing part including a holding member with an ink supply opening part and a sealed ink filling opening part;

a first housing including a holding part holding the holding member of said ink containing part;

a second housing whose outline is analogous to an outline of said first housing;

a third housing fitted to a side of an assembly of said first and second housings from which side ink is supplied; and an engagement mechanism that engages said third housing with said first and second housings, wherein said first, second, and third housings are assemblable and disassemblable.

27. The ink cartridge as claimed in claim 26, wherein said engagement mechanism comprises engagement claws provided to said third housing and engagement recesses provided to said first and second housings, the engagement claws engaging the engagement recesses.

28. The ink cartridge as claimed in claim 26, wherein said engagement mechanism comprises engagement recesses provided to said third housing and engagement claws provided to said first and second housings, the engagement recesses engaging the engagement claws.

29. An ink cartridge housing for containing an ink containing part, comprising:

a first housing including a holding part holding a holding member provided to the ink containing part;

a second housing whose outline is analogous to an outline of said first housing; and a third housing fitted to a side of an assembly of said first and second housings from which side ink is supplied, wherein said first, second, and third housings are assemblable and disassemblable.

30. The ink cartridge housing as claimed in claim 29, further comprising an engagement mechanism that engages said first and second housings.

31. The ink cartridge housing as claimed in claim 30, wherein said engagement mechanism comprises an engagement claw provided to one of said first and second housings and an engagement part provided to the other one of said first and second housings, the engagement claw and the engagement part engaging each other.

32. The ink cartridge housing as claimed in claim 29, further comprising a label applied to each of said first and second housings so as to reinforce engagement of said third housing with said first and second housings.

33. The ink cartridge housing as claimed in claim 29, further comprising a screw member that fixes said first and second housings together.

34. An ink bag sealing ink therein, the ink bag being housed in a housing of an ink cartridge, the ink bag comprising:

a bag-like part formed of a member including an aluminum laminate film; and a holding member including an ink supply opening part and a sealed ink filling opening part, wherein the ink bag engages and is held by an engagement and holding part provided to the housing of the ink cartridge, the housing being an ink cartridge housing as set forth in claim 29.

35. An ink cartridge housing for containing an ink containing part, further comprising:

a first housing including a holding part holding a holding member provided to the ink containing part;

a second housing whose outline is analogous to an outline of said first housing; and a third housing fitted to a side of an assembly of said first and second housings from which side ink is supplied;

an engagement mechanism that engages said third housing with said first and second housings, wherein said first, second, and third housings are assemblable and disassemblable.

36. The ink cartridge housing as claimed in claim 35, wherein said engagement mechanism comprises engagement claws provided to said third housing and engagement recesses provided to said first and second housings, the engagement claws engaging the engagement recesses.

37. The ink cartridge housing as claimed in claim 35, wherein said engagement mechanism comprises engagement recesses provided to said third housing and engagement claws provided to said first and second housings, the engagement recesses engaging the engagement claws.

38. An ink cartridge, comprising:

ink containing means including a holding member with an ink supply opening part and a sealed ink filling opening part;

a first housing including holding means for holding the holding member of said ink containing means;

a second housing whose outline is analogous to an outline of said first housing; and a third housing fitted to a side of an assembly of said first and second housings from which side ink is supplied, wherein said first, second, and third housings are assemblable and disassemblable.

39. An ink-jet recording apparatus into which an ink cartridge containing ink containing means is loadable from a front side thereof, wherein:

the ink cartridge is an ink cartridge as set forth in claim 38.

40. The ink cartridge as claimed in claim 38, further comprising:

positioning means defining a positional relationship between the ink cartridge and ink introduction means provided to an ink container loading part of an image-forming apparatus, wherein the ink cartridge is replaceably attachable to the ink container loading part of the image-forming apparatus.

41. An image-forming apparatus, comprising:

an ink container loading part to which the ink cartridge as set forth in claim 38 is replaceably attachable, wherein said ink container loading part comprises positioning means for loading ink cartridges that contain ink of a single color and have different shapes.

42. An ink cartridge housing for containing ink containing means, comprising:

a first housing including holding means for holding a holding member provided to the ink containing means;

a second housing whose outline is analogous to an outline of said first housing; and a third housing fitted to a side of an assembly of said first and second housings from which side ink is supplied, wherein said first, second, and third housings are assemblable and disassemblable.

43. An ink bag sealing ink therein, the ink bag being housed in a housing of an ink cartridge, the ink bag comprising:

a bag-like part formed of a member including an aluminum laminate film; and a holding member including an ink supply opening part and a sealed ink filling opening part, wherein the ink bag engages and is held by engagement and holding means provided to the housing of the ink cartridge, the housing being an ink cartridge housing as set forth in claim 42.

* * * * *